US011619046B2

(12) United States Patent
Sessler

(10) Patent No.: US 11,619,046 B2
(45) Date of Patent: Apr. 4, 2023

(54) ADJUSTABLE HEADER

(71) Applicant: Jon Sessler, Sumner, WA (US)

(72) Inventor: Jon Sessler, Sumner, WA (US)

( * ) Notice: Subject to any disclaimer, the term of this patent is extended or adjusted under 35 U.S.C. 154(b) by 0 days.

(21) Appl. No.: 17/370,490

(22) Filed: Jul. 8, 2021

(65) Prior Publication Data

US 2022/0018131 A1 Jan. 20, 2022

Related U.S. Application Data

(60) Provisional application No. 63/078,212, filed on Sep. 14, 2020, provisional application No. 63/053,380, filed on Jul. 17, 2020.

(51) Int. Cl.

| | |
|---|---|
| ***E04C 3/00*** | (2006.01) |
| ***E04B 2/76*** | (2006.01) |
| ***E04C 3/29*** | (2006.01) |
| ***E04B 2/74*** | (2006.01) |
| *E04C 3/02* | (2006.01) |
| *E04C 3/04* | (2006.01) |

(52) U.S. Cl.

CPC ..... *E04C 3/005* (2013.01); *E04B 2/74* (2013.01); *E04B 2/76* (2013.01); *E04C 3/29* (2013.01); *E04C 2003/023* (2013.01); *E04C 2003/0417* (2013.01); *E04C 2003/0473* (2013.01)

(58) Field of Classification Search

CPC ..... E04C 3/005; E04C 3/29; E04C 2003/023; E04C 2003/0473; E04C 2003/0417; E04B 2/74; E04B 2/76

USPC ..... 52/118, 204.2, 217, 842, 852

See application file for complete search history.

(56) References Cited

U.S. PATENT DOCUMENTS

| | | | | |
|---|---|---|---|---|
| 2,082,792 | A * | 6/1937 | Dean | B64C 1/065 52/840 |
| 5,625,997 | A | 5/1997 | Callahan et al. | |
| 7,223,043 | B1 | 5/2007 | Andrews | |
| 7,594,331 | B2 | 9/2009 | Andrews et al. | |
| 8,061,099 | B2 | 11/2011 | Andrews | |
| 8,074,416 | B2 | 12/2011 | Andrews | |
| 10,280,618 | B2 | 5/2019 | Kelly | |
| 2002/0116891 | A1 * | 8/2002 | Waldrop | E04B 2/7818 52/843 |
| 2006/0010809 | A1 * | 1/2006 | Lafreniere | E04B 2/766 52/489.1 |
| 2006/0096192 | A1 * | 5/2006 | Daudet | E04B 1/24 52/204.1 |

(Continued)

FOREIGN PATENT DOCUMENTS

WO WO-2004111361 A1 * 12/2004 ..... E04C 3/005

OTHER PUBLICATIONS

"TRAKLOC® Stud Products: TRAKLOC® Elevator Stud™ (TLE)," ClarkDietrich, Apr. 25, 2018, 1 page.

*Primary Examiner* — Brent W Herring

(74) *Attorney, Agent, or Firm* — Seed IP Law Group LLP

(57) ABSTRACT

An adjustable header assembly includes a first piece of material and a second piece of material and at least one bracket. The first piece of material has a fixed length and the second piece of material has an adjustable length. In operation, the length of the second piece of material is adjusted until the second piece of material is proximate wall studs. The second piece of material is then coupled to the studs and the at least one bracket is coupled to the first and second pieces of material.

21 Claims, 17 Drawing Sheets

(56) References Cited

U.S. PATENT DOCUMENTS

| | | | | |
|---|---|---|---|---|
| 2007/0089374 | A1* | 4/2007 | Vasta | E04C 3/07<br>52/204.2 |
| 2018/0221802 | A1* | 8/2018 | Weisbach | B01D 46/0016 |
| 2019/0048589 | A1* | 2/2019 | Kelly | E04C 3/07 |
| 2020/0385988 | A1* | 12/2020 | Kelly | E04C 3/005 |

* cited by examiner

ADJUSTABLE HEADER

BACKGROUND

Technical Field

The present disclosure is directed to headers for use in framing, and in particular, to headers with an adjustable length.

Description of the Related Art

Headers are known for use in the construction industry for framing an opening in a wall, such as for a door. The header is typically a horizontal piece of material that extends across the top of an opening between two vertical wall studs proximate to the opening and acts to disperse structural loads to the studs. For example, without a header, load from the roof or floors above the door opening can compromise the door opening and lead to cracks, shifting, or other problems. As such, the header disperses the load acting on the opening to the studs on opposite sides of the opening for structural stability at the opening.

Many manufacturers are now using prefabricated headers to save time on measuring and cutting headers during the framing process. However, because the exact location of the vertical wall studs proximate the opening can vary, even when architectural plans are used, prefabricated headers often do not fit the openings for which they are intended. For example, if plans call for a 24 inch opening between vertical wall studs for a door, often times the installed distance between the studs will be 26 inches due to measurement error during planning, or error during installation. As such, a prefabricated header at 24 inches will not fit the 26 inch opening. In other situations, the prefabricated header may be too long, such that measuring and cutting is still needed before the header can be installed.

BRIEF SUMMARY

The present disclosure generally describes an adjustable header to be used in framing openings, such as for a window or a door. The adjustable header includes two pieces of material and two brackets. The first piece of material has a constant, fixed length. The second piece of material has an adjustable length. The two pieces of material are aligned and received by the brackets. In other words, the brackets have a "U" shape with a base and opposing flanges and a size and shape to receive the two pieces of material with the two pieces of material on top of each other or side by side. One or both of the flanges of each of the brackets may have pre-drilled holes. In operation, the length of the second piece of material is adjusted and secured to vertical wall studs with fasteners or an additional bracket. The single piece of material overlaps at least a portion of the second piece of material to provide additional support. In some examples, the second piece of material includes two separate sections that are spaced apart and secured to wall studs. As such, the first piece of material extends across the entire distance of the space between the second piece of material to provide support. The brackets are then attached to both of the pieces of material with any one of a number of available fasteners, either through holes in the flanges or directly through the flanges. As such, the adjustable headers described herein may be prefabricated to fit openings of a number of different sizes without the above concerns of known prefabricated headers.

BRIEF DESCRIPTION OF THE SEVERAL VIEWS OF THE DRAWINGS

For a better understanding of the embodiments, reference will now be made by way of example only to the accompanying drawings. In the drawings, identical reference numbers identify similar elements or acts. In some figures, the structures are drawn to scale. In other figures, the sizes and relative positions of elements in the drawings are not necessarily drawn to scale. For example, the sizes, shapes of various elements and angles may be enlarged and positioned in the figures to improve drawing legibility.

DETAILED DESCRIPTION

Figure 1:
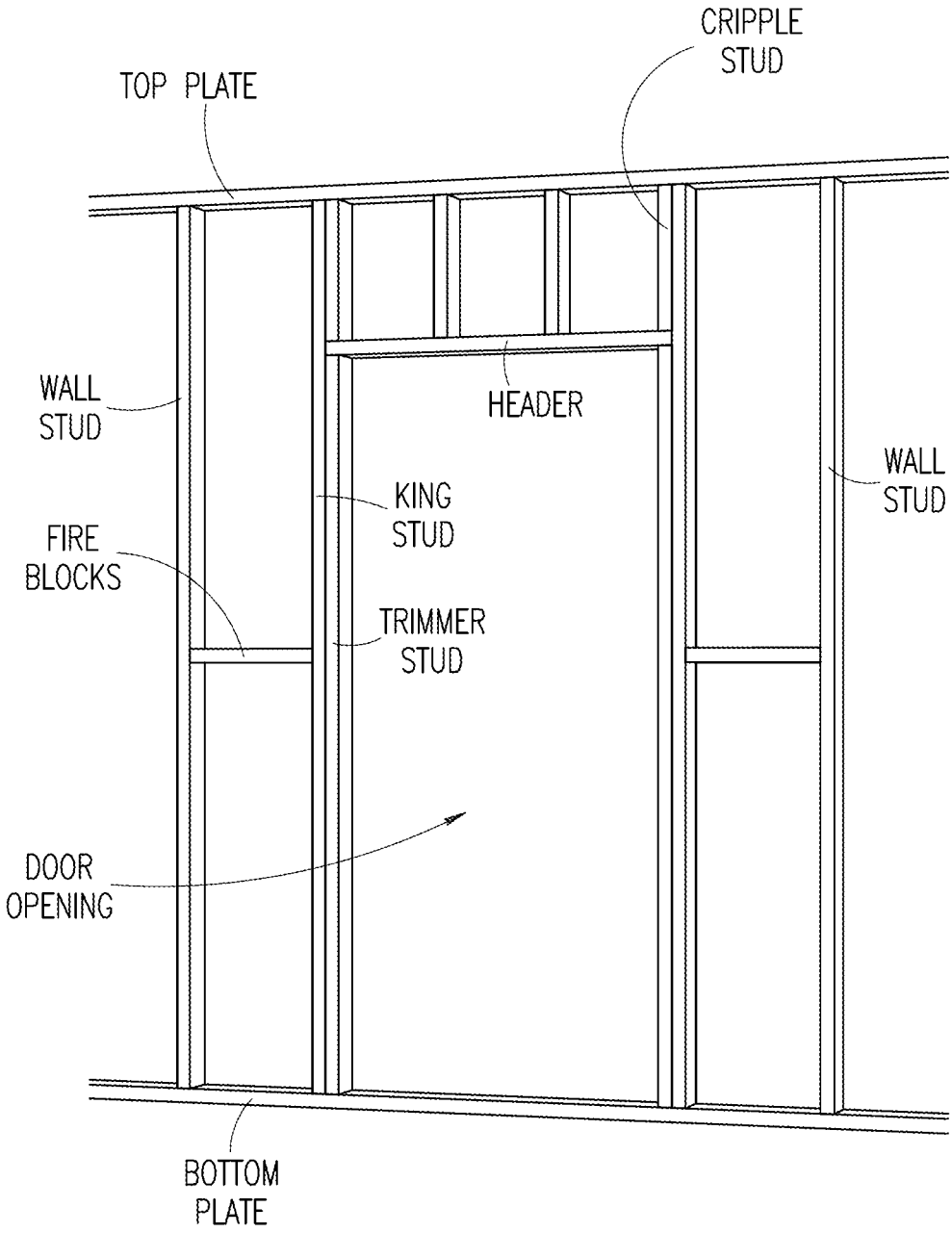
FIG. 1 (PRIOR ART)
FIG. 1 is a perspective view of known wall framing including a header.

FIG. 1 illustrates an example of known wall framing including a header in order to provide background for the embodiments described herein. The framing for a typical wall with an opening, such as a door opening as in FIG. 1, includes a top plate and a bottom plate extending horizontally at the top and bottom of the frame, respectively. Between the top and bottom plates are vertical wall studs. The vertical wall studs are secured to the top and bottom plates and are spaced apart from each other, typically by a set distance. For example, in most residential construction, the wall studs are spaced 16 inches from each other. Horizontal fire blocks are secured to adjacent pairs of wall studs in order to slow the spread of fire through concealed spaces of a building. The fire blocks are spaced from each of the top and bottom plates and are sometimes staggered along a centerline between the top and bottom plates. The framing for a door opening includes a king stud on each side of the opening. King studs are full length studs similar to wall studs. Then, a header is secured to the king studs across the door opening, typically at the height of the door to be installed. As referenced above, the header provides support for the door to be installed and distributes load to the king and trimmer studs.

Trimmer studs are coupled to and extend from the header to the bottom plate to provide additional support for the header and to carry load distributed around the door opening. Cripple studs are coupled to and extend from the header to the top plate to help distribute load to the header and to the king and trimmer studs. As such, the distance between the king studs determines the length of the header, but this distance can vary from architectural plans during installation. For example, the king studs and trimmer studs may be spaced several inches further apart from each other than planned, due to any number of errors that can occur during framing. In that case, the door can still be installed in the opening through use of blocks or shims to close the space between the trimmer studs and the door frame. However, if a known prefabricated header is to be used for such an opening, the header will not fit in the opening. Alternatively, the header will have to be customized onsite, which increases the amount of on-site measuring and cutting, thereby increasing cost and reducing efficiency.

Figure 2:
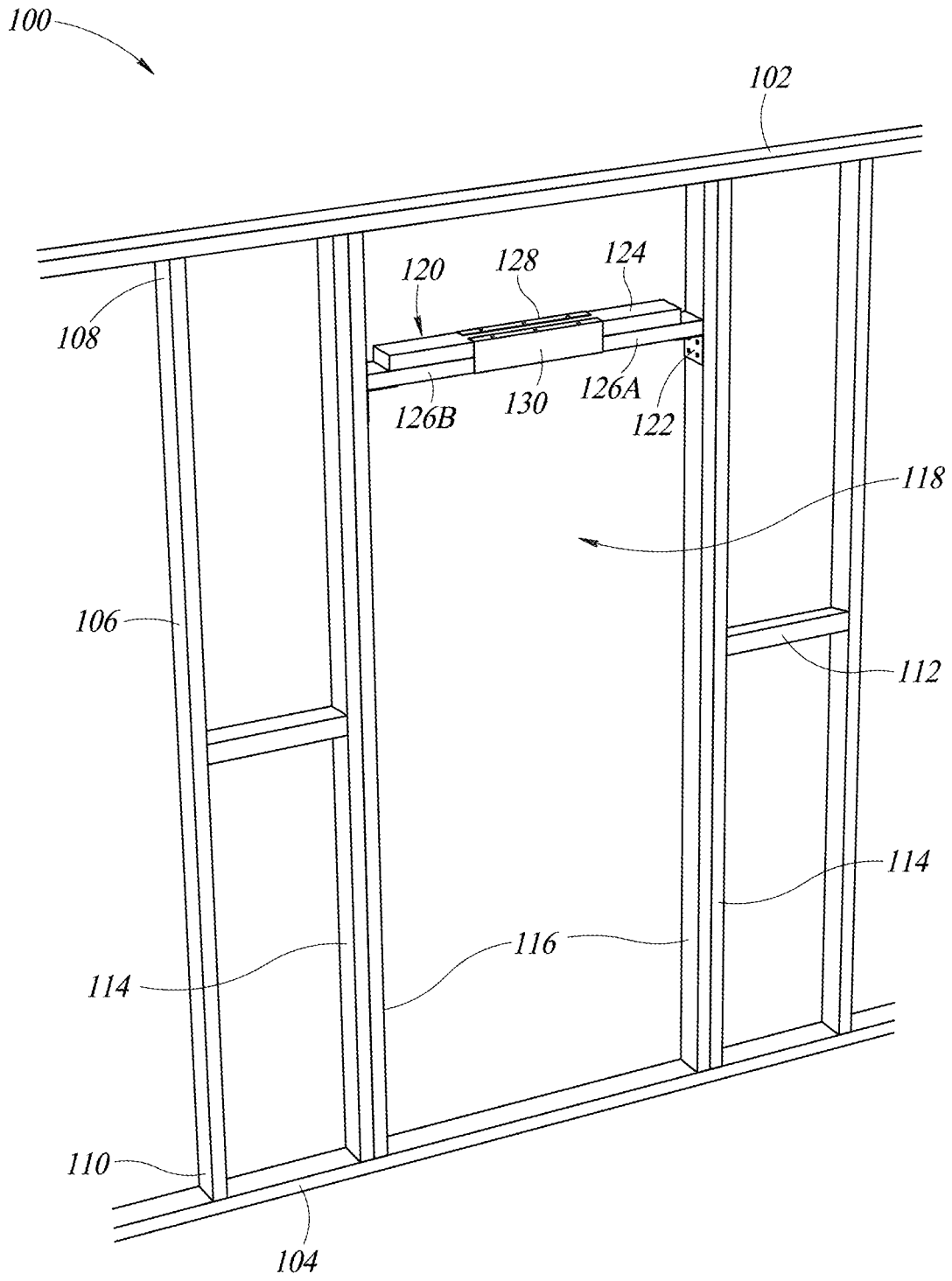
FIG. 2 is a perspective view of an embodiment of an adjustable header according to the present disclosure in an extended configuration and coupled to wall studs.

FIG. 2 is a perspective view of a wall framing assembly 100 according to embodiments of the present disclosure. The wall framing assembly 100 includes a top plate 102 and a bottom plate 104. In some embodiments the top plate 102 and the bottom plate 104 are arranged horizontal at the top and bottom, respectively, of the wall framing assembly 100. A distance between the top and bottom plates 102, 104 can be selected according to design preference. For example, the distance between the top and bottom plates 102, 104, may be 8 feet or less, or 10 feet, or 12 feet or more, which corresponds to a selected wall height. The assembly 100 further includes a plurality of wall studs 106. The wall studs 106 are arranged vertically and spaced from each other.

In various embodiments, the wall studs 106 are spaced 12 inches or less, 14 inches, 16 inches, 18 inches, 20 inches, 22 inches, or 24 or more inches from each other in a horizontal or lateral direction. Each of the wall studs 106 extend between the top and bottom plates 102, 104 and are coupled to the top and bottom plates 102, 104 at both ends. More specifically, each of the studs 106 have a first end 108 and a second end 110 opposite the first end 108, wherein the first end 108 is coupled to the top plate 102 and the second end 110 of each stud 106 is coupled to the bottom plate 104. As such, the first end 108 may be referred to as a top end 108 and the second end may be referred to as a bottom end 110 of each stud 106.

Fire blocks 112 are coupled to and extend between successive pairs of wall studs 106. In some embodiments, the fire blocks 112 are staggered from a horizontal center line between the top and bottom plates 102, 104, such as being staggered 4 feet from the bottom plate 104 in embodiments where the assembly is for a standard 8 foot wall. A king stud 114 is coupled to and extends between the top and bottom plates 102, 104 on either side of a door opening 118. In some embodiments, the door opening 118 is a window opening, or some other opening in the framing assembly 100. As such, embodiments of the present disclosure not limited to only headers for doors, but can instead include headers for any use in framing. The king studs 114 are full length studs, similar to the wall studs 106, such that they extend between the top and bottom plates 102, 104. Trimmer studs 116 are adjacent the king studs 114 on either side of the door opening 118. In some embodiments, the trimmer studs 116 are also full length studs extending between the top and bottom plates 102, 104, as opposed to the trimmer studs described in FIG. 1, which extend from the header to the bottom plate. However, in one or more embodiments, the trimmer studs 116 may extend from a header assembly 120 to the bottom plate 104.

The header assembly 120 extends between the trimmer studs 116 and is coupled to the trimmer studs 116 with brackets 122. The header assembly 120 includes a first piece of material 124, for example in the form a metal stud and a second piece of material 126 that is in the form of metal studs 126A, 126B coupled together with brackets 128, 130. The shape and construction of metal studs is well known in the art and thus need not be repeated here. The header assembly 120, pieces of material 124, 126A, 126B and brackets 128, 130 will be described in greater detail with reference to FIGS. 3A-4B herein. The header assembly 120 has an adjustable length, such that the header assembly 120 can be used with openings 118 of different widths or sizes. In other words, in some embodiments, the header assembly 120 has an adjustable length in a range that is selected according to design preference. For example, the adjustable length of the header assembly 120 may be between 12 and 16 inches, between 16 and 20 inches, between 20 and 24 inches, between 24 and 28 inches, or between 28 and 32 inches, or more or less than any of these ranges. In some embodiments, the range of extension of the length of the header assembly 120 is 4 inches, 6 inches, 8 inches, or more or less.

In FIG. 2, each of the studs 106, 114, 116 can be secured to the top and bottom plates 102, 104 with fasteners, such as screws, nails, bolts, and the like or with any number of available brackets in combination with fasteners. Similarly, the fire blocks 112 can be secured to wall studs 106 with fasteners or brackets. The brackets 122 are likewise secured to the trimmer studs 116 with fasteners. The brackets 122 have pre-drilled holes for receiving fasteners, in some embodiments. However, in one or more embodiments, the brackets 122 do not have pre-drilled holes and instead, the installer secures the fasteners through the brackets 122 at selected locations. Further, each of the studs 106, 114, 116, each of the bottom plates 102, 104 and the fire blocks 112 can be any number of different materials, such as wood, steel, aluminum, or other like framing materials. For example, in the illustrated embodiments, the elements of the framing assembly 100 referenced above are all dimensional lumber, such as 2×4s or 2×6s. The elements of the framing assembly 100 may also be light or heavy gauge steel studs or other materials with dimensions from 1⅝" to 12", or more or less, in some embodiments.

Figure 3A:
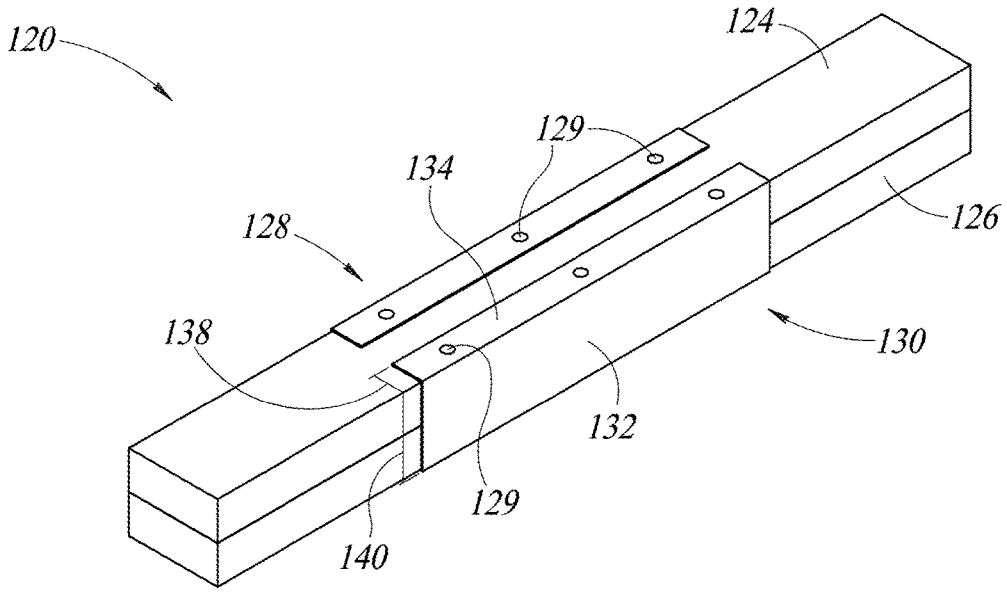
FIG. 3A is a perspective top view of the adjustable header of FIG. 1 in a collapsed configuration.
Figure 3B:
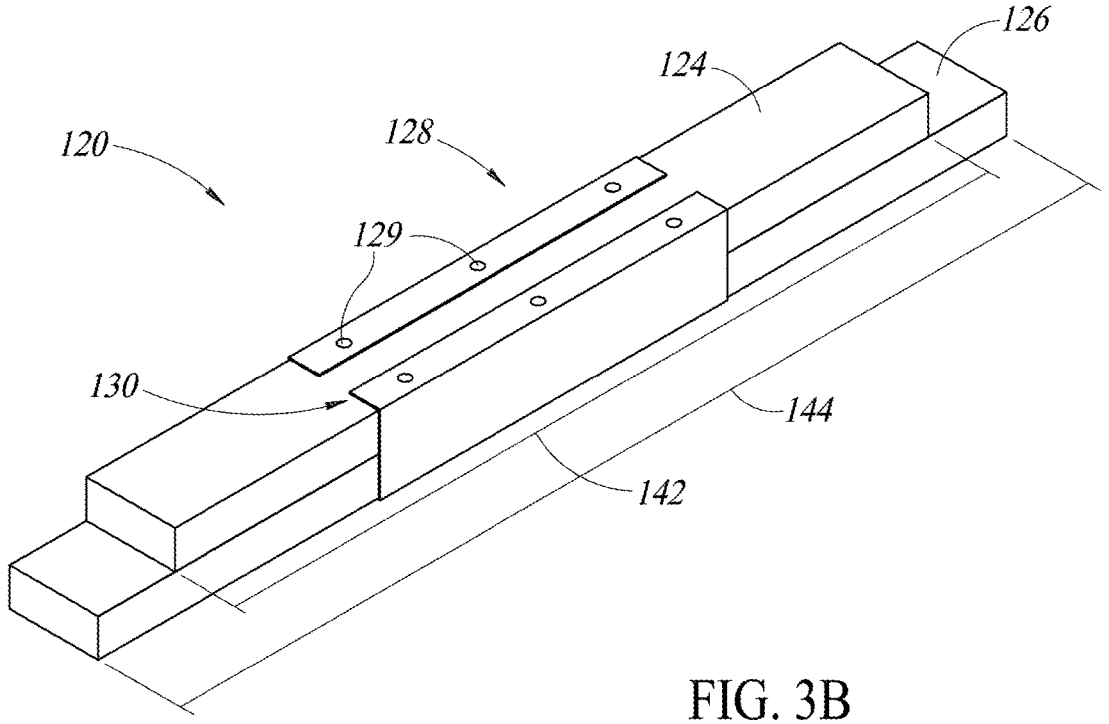
FIG. 3B is a perspective top view of the adjustable header of FIG. 1 in the extended configuration.
Figure 4A:
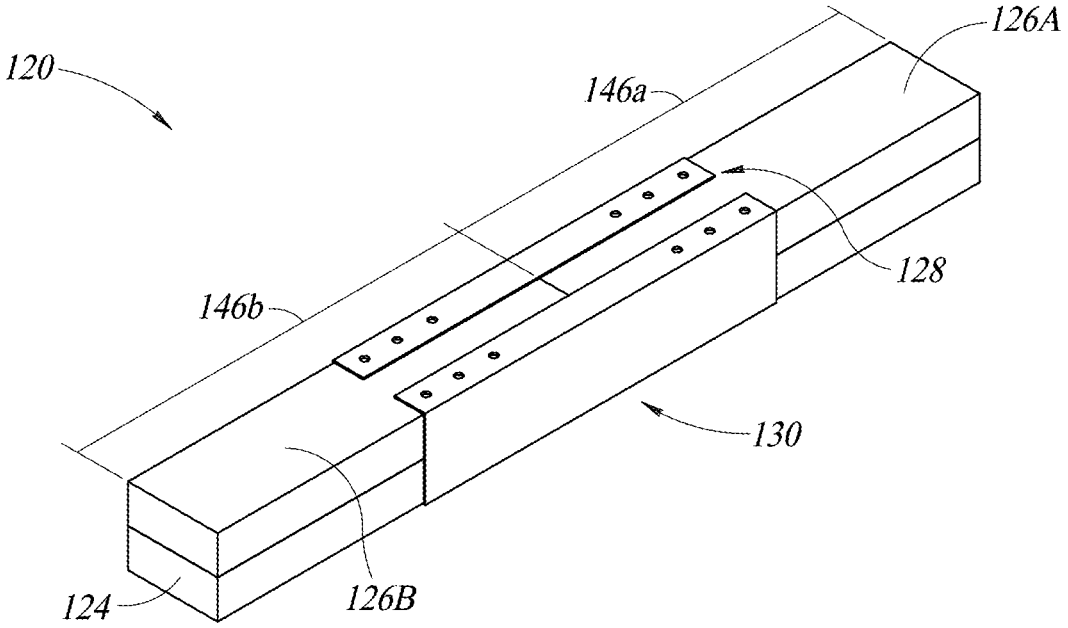
FIG. 4A is a perspective bottom view of the adjustable header of FIG. 1 in the collapsed configuration.
Figure 4B:
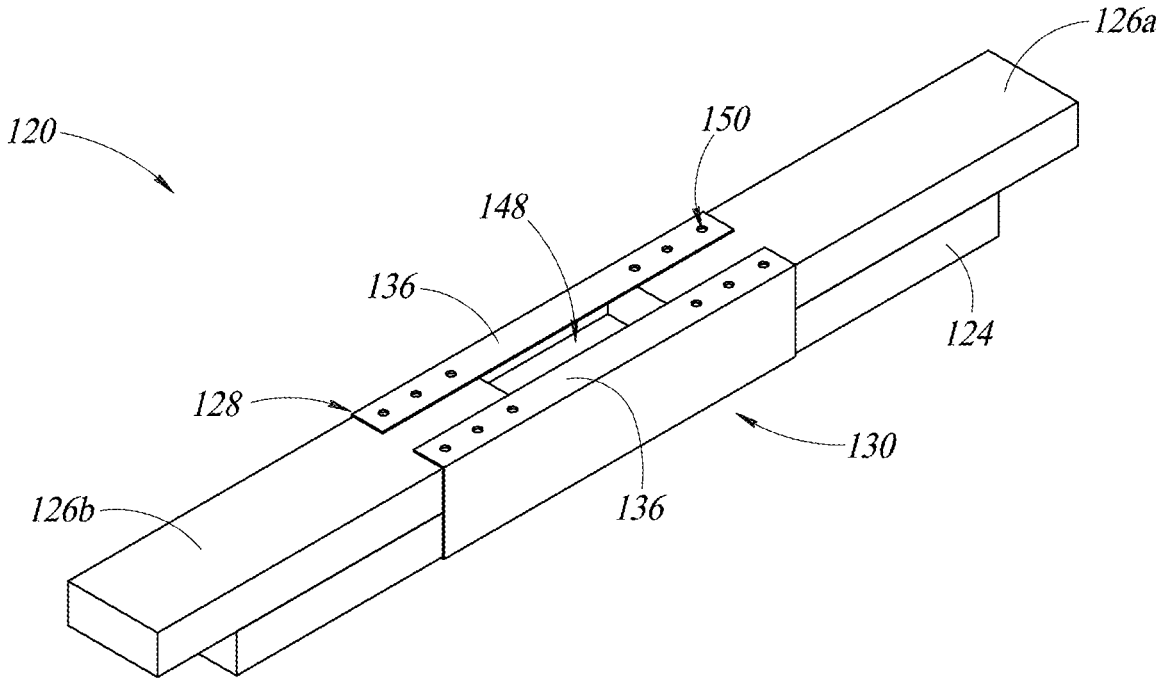
FIG. 4B is a perspective bottom view of the adjustable header of FIG. 1 in the extended configuration.

FIG. 3A, FIG. 3B, FIG. 4A, and FIG. 4B provide additional detail of the header assembly 120. More specifically, FIGS. 3A and 3B show the top of the header assembly 120 in the collapsed and extended configurations, respectively, and FIGS. 4A and 4B show the bottom of the header assembly 120 in the collapsed and extended configurations, respectively, in one or more embodiments. Beginning with FIG. 3A, the header assembly 120 includes the first piece of material 124 (which may also be referred to as a first support 124) and the second piece of material 126 (which may also be referred to as a second support 126). In the illustrated embodiment, the first piece of material 124 is directly adjacent to the second piece of material 126 and aligned on top of the second piece of material 126. As will be described further below, the second piece of material 126 is configured to translate relative to the first piece of material 124 in order to adjust a length of the second piece of material 126 and the header assembly 120. In the illustrated embodiments, the pieces of material 124, 126 are illustrated as standard 2×4 dimensional framing lumber. However, as referenced above, the pieces of material 124, 126 can be any other framing material, such as steel or aluminum framing elements, or dimension lumber of a different size, among others.

The header assembly 120 further includes a first bracket 128 and a second bracket 130 structured to receive the first and second pieces of material 124, 126. In other words, the brackets 128, 130 each have a size and a shape to receive the pieces of material 124, 126 when the pieces of material 124, 126 are adjacent to each other, as illustrated. Each of the brackets 128, 130 include a base plate 132 coupled to a first flange 134 and a second flange 136 (see FIGS. 4A and 4B). The flanges 134, 136 are spaced from each other across the base plate 132 and in some embodiments, are perpendicular to the base plate 132, such that the brackets 128, 130 have an overall "U" shape with square corners. The first flange 134 is configured to be secured to the first piece of material 124, such as with fasteners.

More specifically, in some embodiments, the first flange 134 is fixed to the first piece of material 124 with fasteners 129, which may be screws, rivets, bolts, or any other fastener. The fasteners 129 secure the first piece of material 124 to the brackets 128, 130, such that the first piece of material 124 cannot move relative to the brackets 128, 130. Although FIG. 3A and FIG. 3B illustrate three fasteners 129 through first flange 134 of each bracket 128, 130, it is to be appreciated that there can be more or less than three fasteners 129 in each bracket 128, 130. In one or more embodiments, the first flange 134 is a solid, continuous sheet of material having flat and planar surfaces without any pre-drilled holes or indentations. Thus, the installer can couple the first flange 134 to the first piece of material 124 with fasteners 129 that are inserted through the first flange 134 at locations selected by the installer.

In one or more embodiments, the first flange 134 includes pre-drilled holes, similar to the type described herein, for coupling the first flange 134 to the first piece of material 124 with fasteners 129 inserted through the holes. In one or more embodiments, the first flange 134 of each bracket 128, 130 includes pre-drilled holes for receiving fasteners 129, but the first piece of material 124 does not include pre-drilled holes. In embodiments where the first piece of material 124 is metal, the holes in the first flange 134 act as a pilot to help with starting the coupling of the fasteners 129 to the first piece of material 124.

The base plate 132 is also a solid, continuous sheet of material without any holes, in one or more embodiments. In some embodiments, the base plate 132 is not secured to the pieces of material 124, 126, but rather, provides structural support for the header assembly 120, wherein only the flanges 134, 136 are secured to the pieces of material 124, 126. However, the base plate 132 may also be secured to the pieces of material 124, 126 with fasteners inserted through the base plate 132, or through pre-drilled holes in the base plate 132. Each of the flanges 134, 136 has a dimension 138, which may be a width, and the base plate 132 has a dimension 140, which may be a height. In one or more embodiments, the dimension 138 is less than the dimension 140. In some embodiments, the dimension 138 is less than half of the dimension 140.

In yet further embodiments, the dimension 138 is greater than the dimension 140 or the dimensions 138, 140 are equal. For example, it is acceptable if the width of the top and bottom flanges 134 and 136 of each bracket 128, 130 equals the width of the respective pieces of material or studs 124, 126 such that the brackets 128, 130 fully enclose the respective pieces of material or studs 124 and 126. The benefit of a slight space is that a user can more easily see how far apart portions 126*a* and 126*b* (FIG. 4A) of the second piece of material 126 are, but this is not required. Further, the structure of brackets 130 and 128 can be formed as a single piece square channel in one embodiment with each of the flanges 134, 136 having a length that is equal to the length of the base plate 130, although the same is not required, as the flanges 134 may be shorter or longer than the base plate 130 and vice versa.

In one or more embodiments, the size and shape of each of the first and second flanges 134, 136 is the same, while in other embodiments, the size and shape of the flanges 134, 136 is different. For example, each of the second flanges 136 may have a greater width than the first flanges 134 to provide additional support underneath the header assembly 120 for distribution of load through header assembly 120. The first flange 134 of the first bracket 128 is spaced across the first piece of material 124 from the first flange 134 of the second bracket 130. Further, in some embodiments, the header assembly 120 includes only one bracket between brackets 128, 130, while in other embodiments, both brackets 128, 130 are included in header assembly 120.

FIG. 3B illustrates the header assembly 120 in the extended configuration with the second piece of material 126 extended relative to the first piece of material 124 and the brackets 128, 130. In other words, the header assembly 120 has a first length 142 in the collapsed configuration, which corresponds to a length of the first piece of material 124, and a second length 144 in the extend configuration, which corresponds to a length of the second piece of material 126. The second length 144 is greater in the extended configuration than the first length 142 because of the extension of the second piece of material 126. The second length 144 may be greater than the first length 142 by a distance that is determined by the width of the opening in which the header assembly 120 is installed, such as door opening 118 in FIG. 2. However, in general, the header assembly 120 can include the first length 142 and the second length 144 being the same, or the second length 144 selected to be at least 0.5 inch, at least 1 inch, at least 2 inches, at least 3 inches, at least 4 inches, at least 5 inches, or at least 6 or more inches greater than the first length 142. The above lengths include all fractional components of an inch as well. As such, the second length 144 may be greater than the first length 142 by at least 1.25 inches, at least 1.5 inches, and all other fractions of an inch. In some embodiments, the first and second lengths 142, 144 are equal, such as when the header assembly 120 is installed in the collapsed configuration shown in FIG. 3A. As shown in FIG. 3B, the first piece of material 124 does not move relative to brackets 128, 130 because of the fasteners 129. Only the second piece of material 126 is adjustable, in some embodiments.

FIGS. 4A and 4B illustrate the bottom of the header assembly 120 and provide additional detail regarding the second piece of material 126. As shown in FIG. 4A, the second piece of material 126 includes two separate and distinct portions or pieces 126*a*, 126*b*. The individual pieces 126*a*, 126*b* have a third length 146*a* and a fourth length 146*b*, respectively. As illustrated, the third and fourth lengths 146*a*, 146*b* are equal, although in other embodiments, the third and fourth lengths are different, such as the third length 146*a* being greater or less than the fourth length 146*b*. Further, the sum of the third and fourth lengths 146*a*, 146*b* is equal to the first length 142 in FIG. 3B, which is the length of the first piece of material 126. In the collapsed configuration shown in FIG. 4A, the individual pieces 126*a*, 126*b* are directly adjacent to each other. In one or more embodiments, ends of the individual pieces 126*a*, 126*b* are in contact with each other proximate a center of the brackets 128, 130 in the collapsed configuration. However, in some embodiments, there may be a small gap or space between the ends of the pieces 126*a*, 126*b* in the collapsed configuration, such that the pieces 126*a*, 126*b* may not be in direct contact, but rather, are adjacent to each other with a slight space between them.

When the header assembly 120 is adjusted to fit an opening, the individual pieces 126*a*, 126*b* of the second piece of material 126 are translated away from each other as in FIG. 4B, such that there is a gap or space 148 between ends of the individual pieces 126*a*, 126*b*. A length or width of the space 148 corresponds to an amount of extension of the pieces 126*a*, 126*b* relative to the first piece of material 124. Further, to provide structural integrity to the assembly 120, the first piece of material 124 overlaps the space 148 and extends across the space 148 and beyond the ends of the individual pieces 126*a*, 126*b*. Further, the header assembly 120 includes the second flanges 136 of each bracket 128, 130 having pre-drilled holes 150 for securing the second flanges 136 of each bracket 128, 130 to the individual pieces 126*a*, 126*b*. Each second flange 136 is therefore secured to both of the individual pieces 126*a*, 126*b* of the second piece of material 126. As referenced above, the pre-drilled holes 150 are useful to assist with fastening the brackets 128, 130 to the individual pieces 126*a*, 126*b* of the second piece of material 126. The pre-drilled holes 150 and brackets 128, 130 assist with starting fasteners in the installation process, which increases efficiency and reduces errors in installation. The pre-drilled holes 150 therefore act as a pilot to assist with installing fasteners through holes 150, in some embodiments.

In some embodiments, the second piece of material 126 may be a single, continuous piece with a fixed length, similar to the first piece of material 124, such that the first and second pieces of material 124, 126 translate relative to each other to adjust a length of the header assembly 120. In such embodiments, one end of each of the pieces of material 124, 126 overlaps with and is received in the brackets 128, 130 so that the brackets 128, 130 can be secured to the pieces of material 124, 126. Thus, the individual pieces 126*a*, 126*b* of the second piece of material 126 are adjusted to change the second length 144 (FIG. 3B) of the header assembly 120 to fit an opening. Once the individual pieces 126*a*, 126*b* are proximate trimmer or king studs, as in FIG. 2, the individual pieces 126*a*, 126*b* are secured to the studs with additional brackets (such as brackets 122 in FIG. 2) and fasteners or directly with fasteners through the individual pieces 126*a*, 126*b* and the studs. The first piece of material 124 is not coupled directly to the studs in some embodiments, but rather is spaced from the studs on both ends of the first piece of material 124 and provides support for the portions 126*a*, 126*b* of the second piece of material through the structure of the assembly 120.

Figure 5:
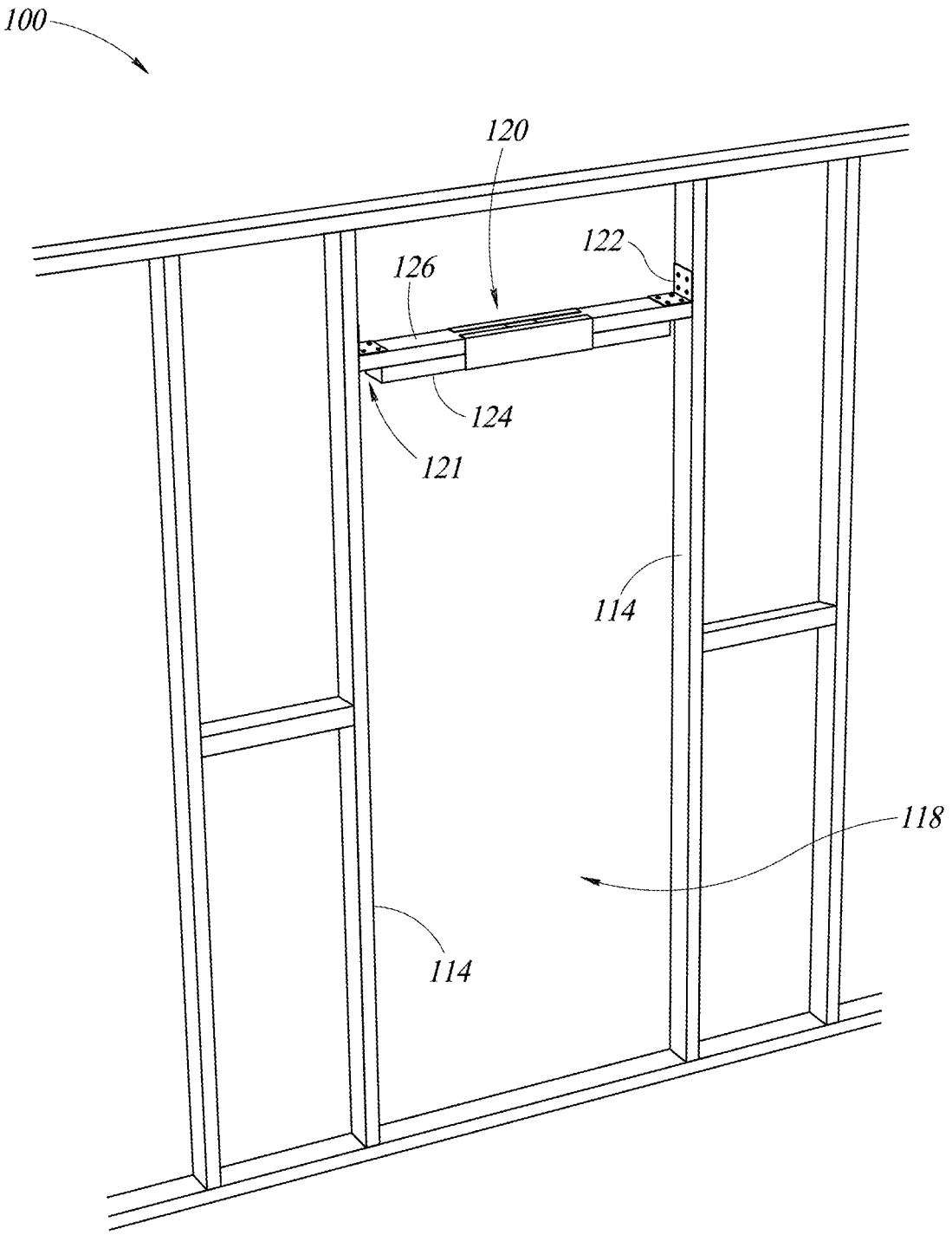
FIG. 5 is a perspective view of the adjustable header of FIG. 1 coupled to wall studs in an alternative orientation.

In FIG. 2, the header assembly 120 is illustrated as being coupled to the trimmer studs 116 with the first piece of material 124 above the second piece of material 126. However, embodiments of the present disclosure also include installing the header assembly 120 in different orientations and secured to different types of framing. For example, FIG. 5 illustrates the framing assembly 100 without trimmer studs. Rather, the framing assembly 100 includes only king studs 114 on opposite sides of opening 118. The header assembly 120 is installed in the opening 118 and coupled directly to the king studs 114. In the illustrated embodiment, the header assembly 120 is inverted compared to the configuration in FIG. 2, with the first piece of material 124 that is fixed in length below the second piece of material 126 that is adjustable in length. Further, the bracket 122 may be coupled to the second piece of material 126 and the king studs 114, with the bracket 122 above the header assembly 120 instead of below the header assembly 120, as in FIG. 2. The header assembly 120 includes a gap or space 121 between ends of the first piece of material 124 and king studs 114 to which the header assembly 120 is coupled because of the fixed length of the first piece of material 124 and the adjustable length of the second piece of material 126.

Figure 6:
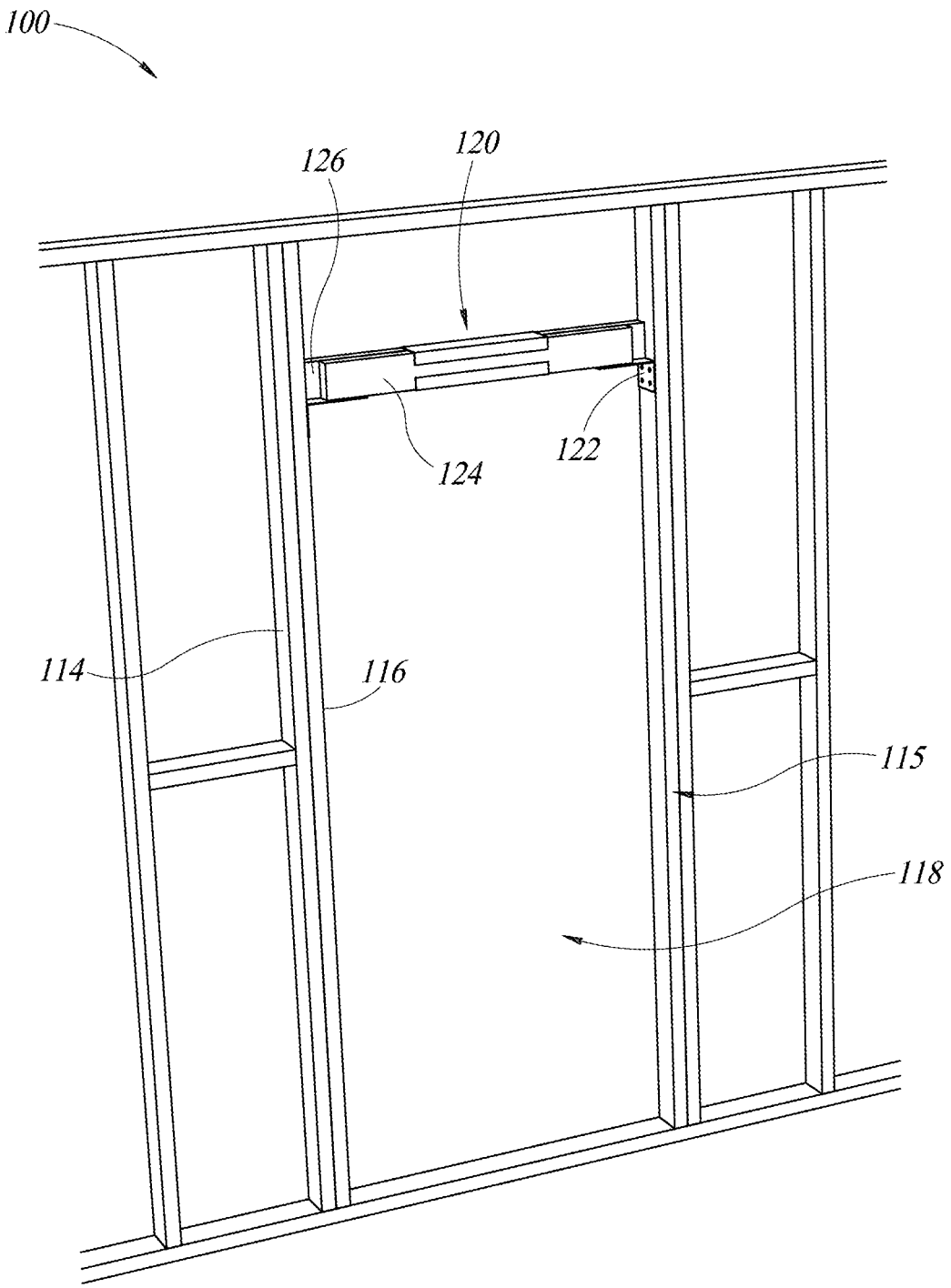
FIG. 6 is a perspective view of the adjustable header of FIG. 1 coupled to wall studs in an alternative orientation.

FIG. 6 illustrates the framing assembly 100 with the king stud 114 and the trimmer stud 116 on opposite sides of opening 118. In one or more embodiments, the trimmer stud 116 is a full length stud such that king stud 114 and trimmer stud 116 may generally be referred to as standard wall studs that are doubled in thickness for extra support around opening 118. The header assembly 120 is coupled to the trimmer studs 116 with the first piece of material 124 and a second piece of material 126 side by side. In the illustrated embodiment, the first piece of material 124 is orientated towards a front surface 115 of the trimmer studs 116, wherein the front surface 115 is a surface facing into a room. The second piece of material 126 is behind the first piece of material 124 and further spaced from the front surface 115 of the trimmer studs 116 by the first piece of material 124.

However, some embodiments include an opposite arrangement, with the second piece of material 126 positioned proximate the front surface 115 of the trimmer studs 116 and the first piece of material 124 behind the second piece of material 126 and spaced further from the front surface 115 of the trimmer studs 116. Further, the framing assembly 100 includes brackets 122, which may have a greater length underneath the header assembly 120 than brackets 122 in FIG. 2 to provide additional support for the side by side configuration shown in FIG. 6. In other words, in some embodiments, the brackets 122 extend to support both pieces of material 124, 126, although one or more embodiments include the brackets 122 supporting only one of the first and second pieces of material 124, 126.

Figure 7A:
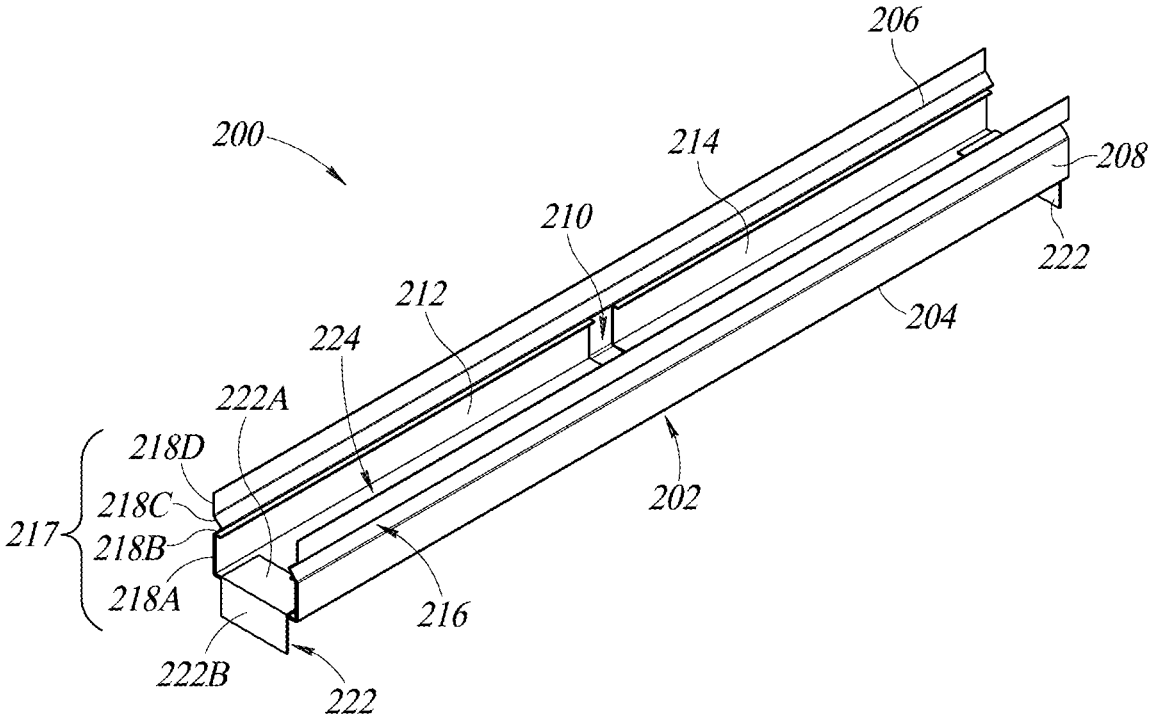
FIG. 7A is a perspective top view of an embodiment of an adjustable header according to the present disclosure in a collapsed configuration.
Figure 7B:
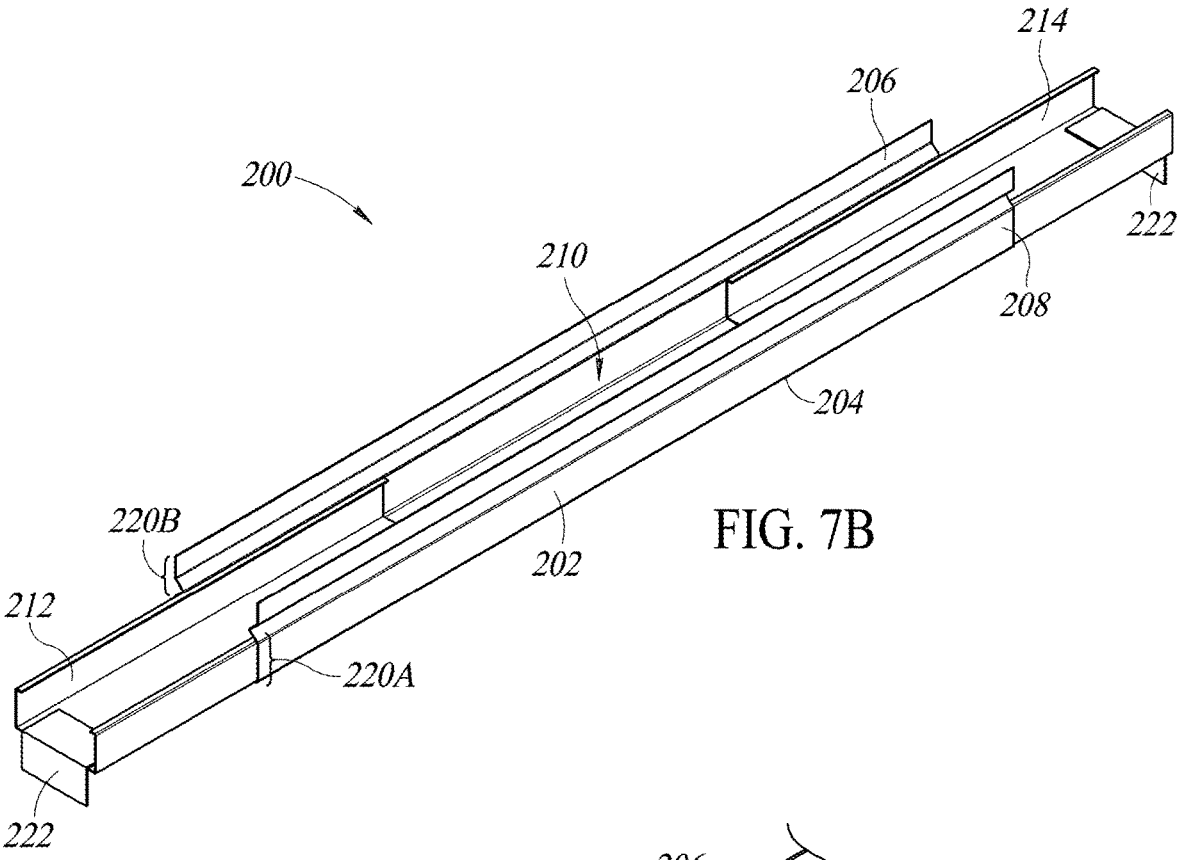
FIG. 7B is a perspective top view of the adjustable header of FIG. 7A in an extended configuration.
Figure 7C:
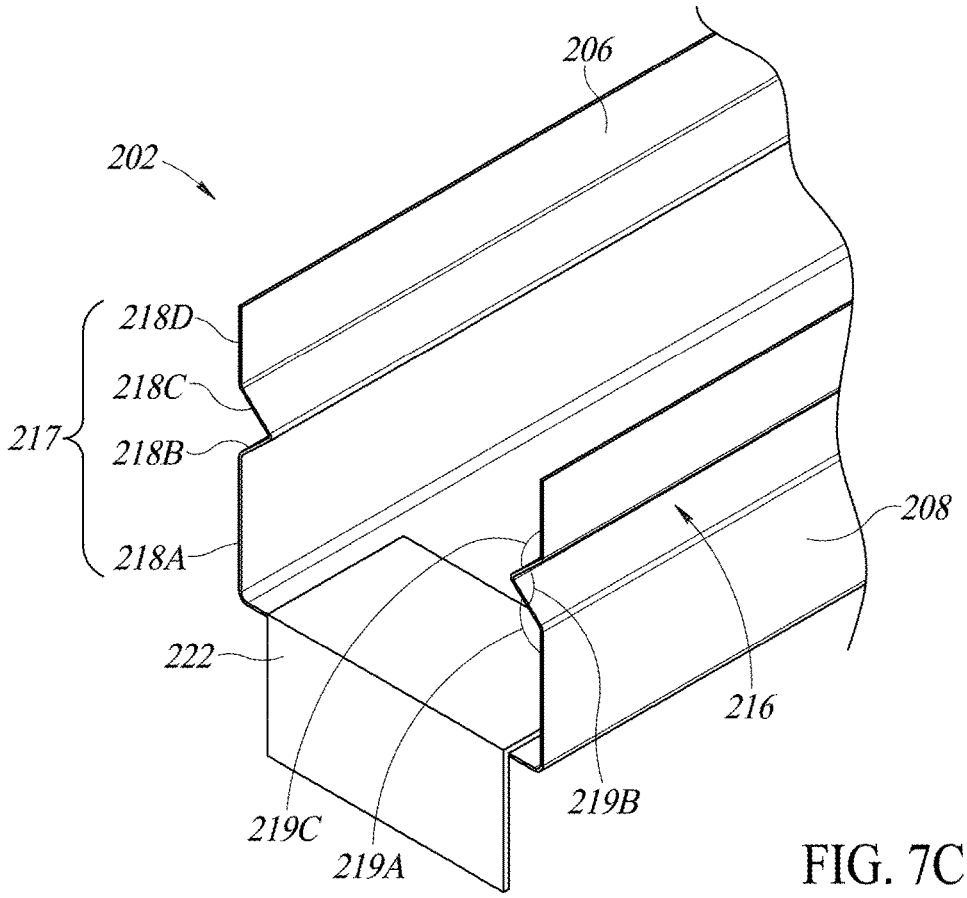
FIG. 7C is a detail view of a track of the adjustable header of FIG. 7A.
Figure 8A:
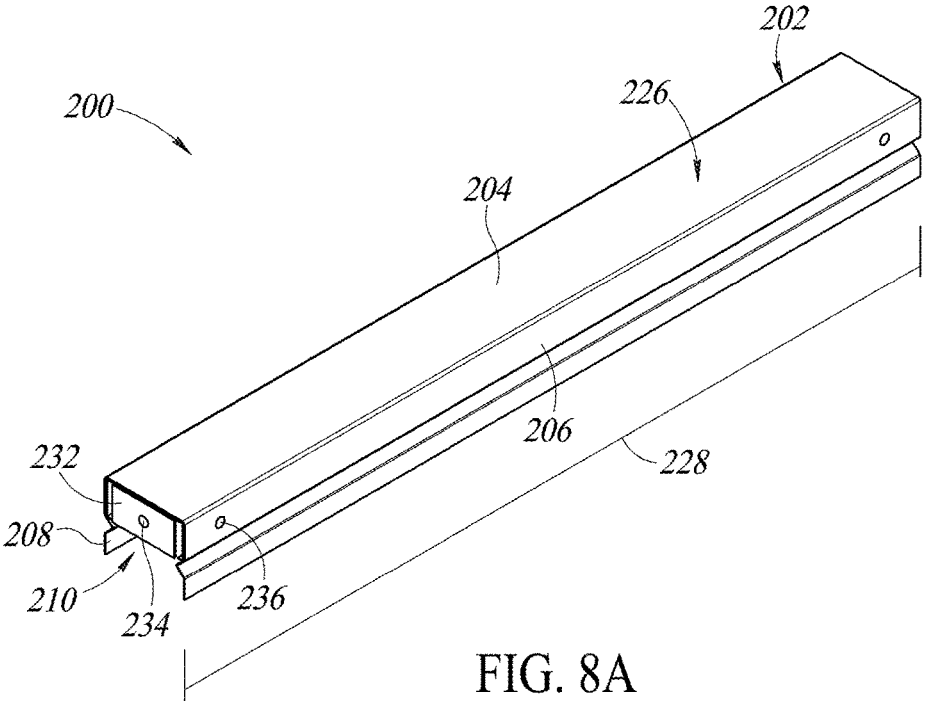
FIG. 8A is a perspective bottom view of the adjustable header of FIG. 7A.
Figure 8B:
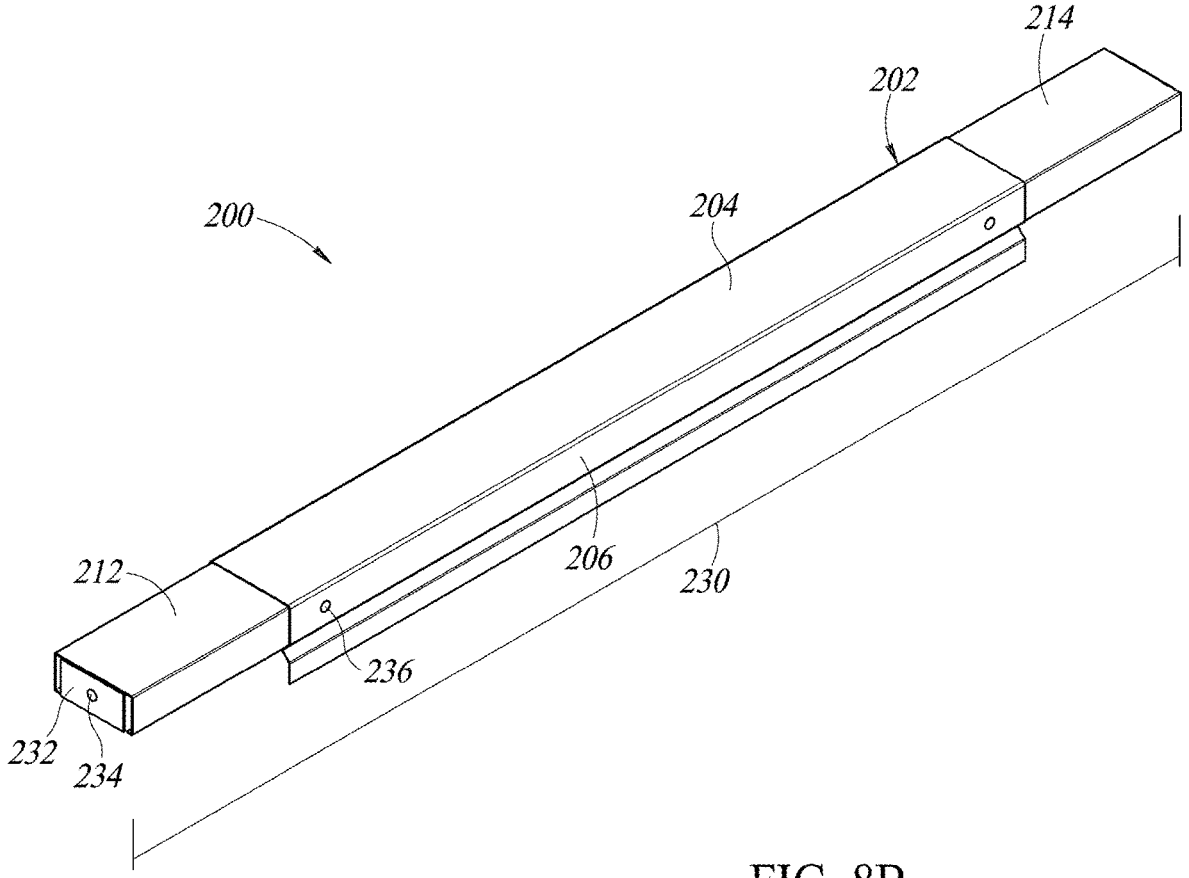
FIG. 8B is a perspective bottom view of the adjustable header of FIG. 7B.
Figure 9A:
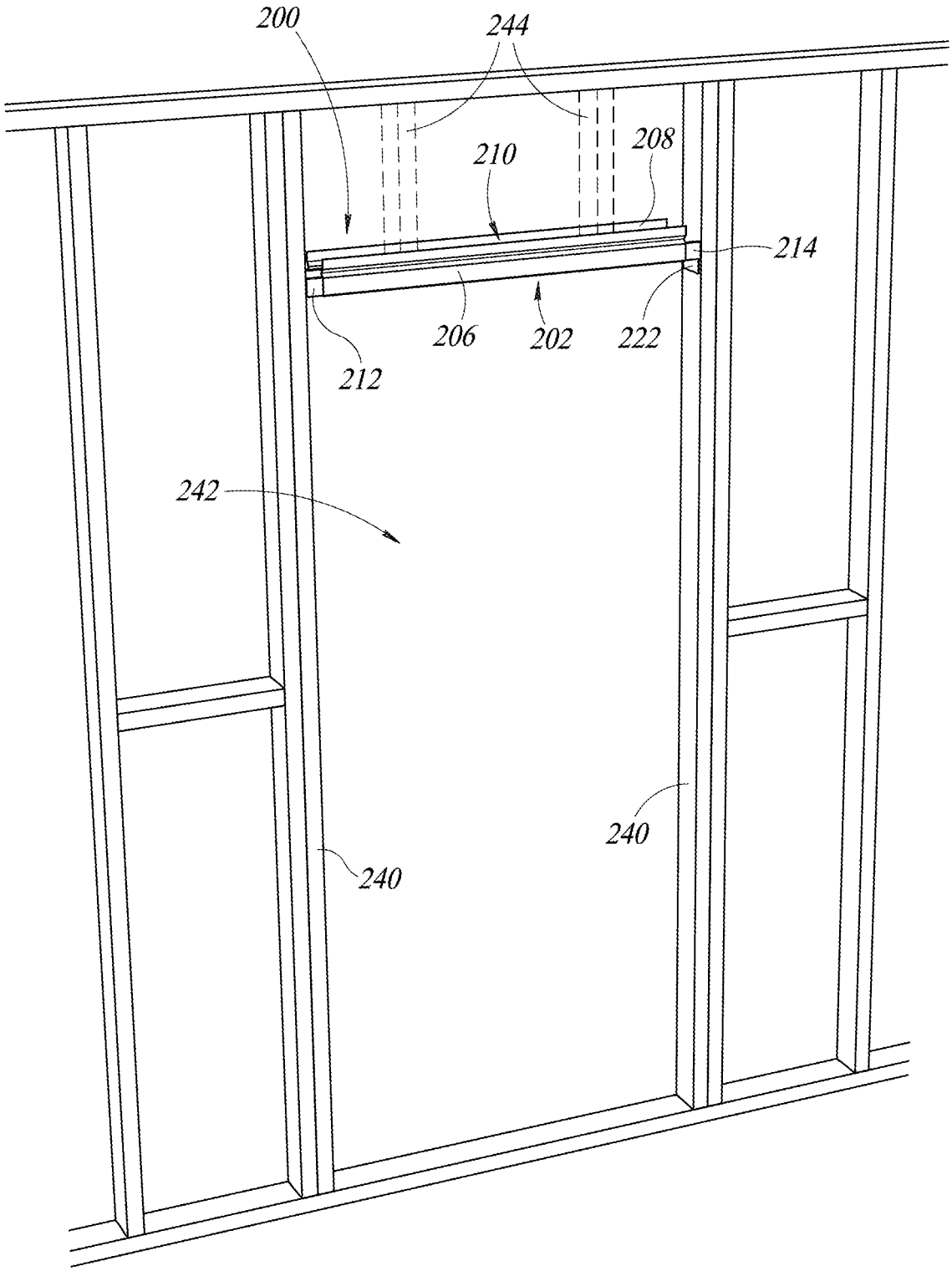
FIG. 9A is a perspective view of the adjustable header of FIG. 7A coupled to wall studs.
Figure 9B:
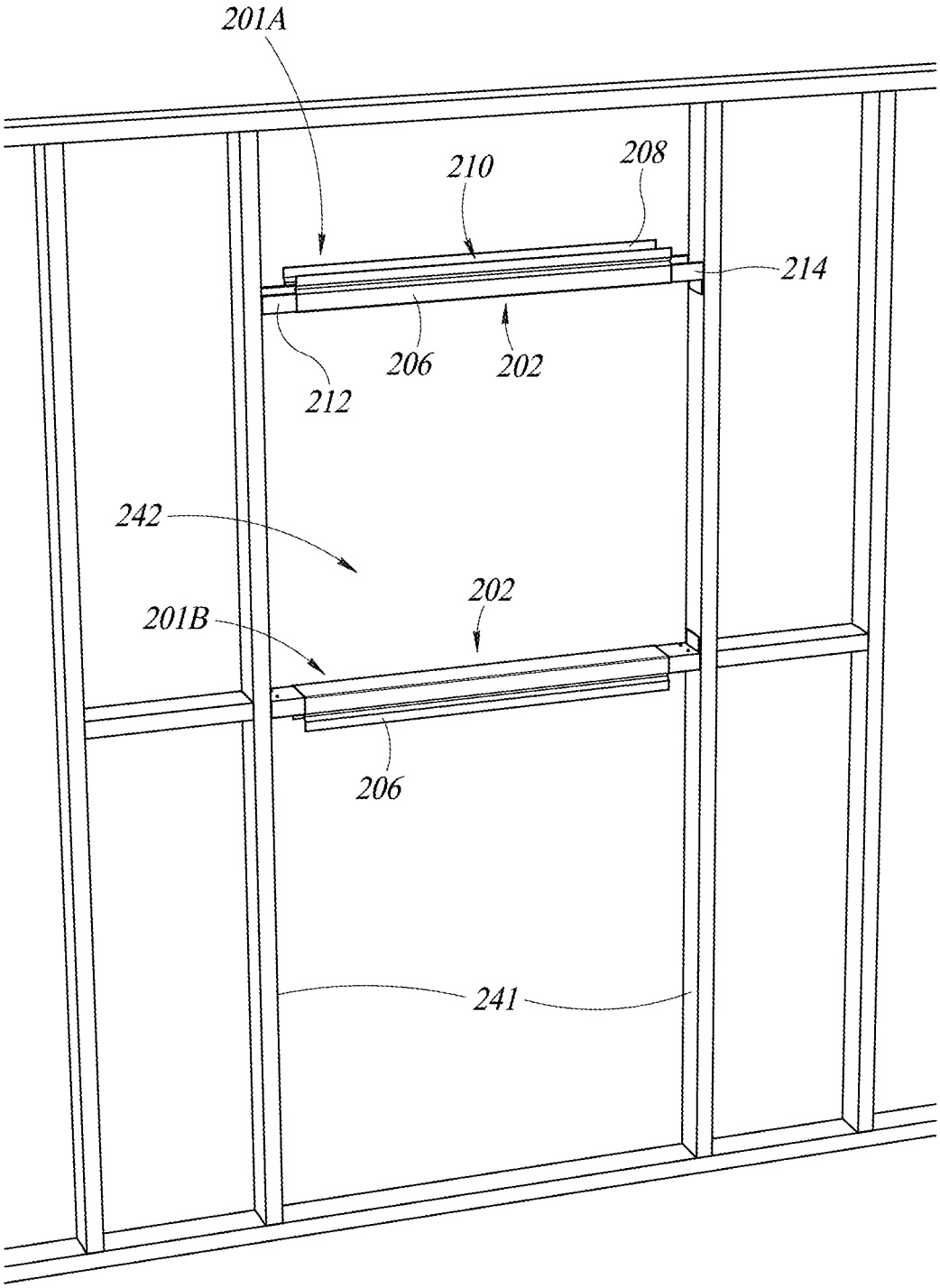
FIG. 9B is a perspective view of an embodiment of multiple window sill framing members coupled to wall studs according to the present disclosure.
Figure 9C:
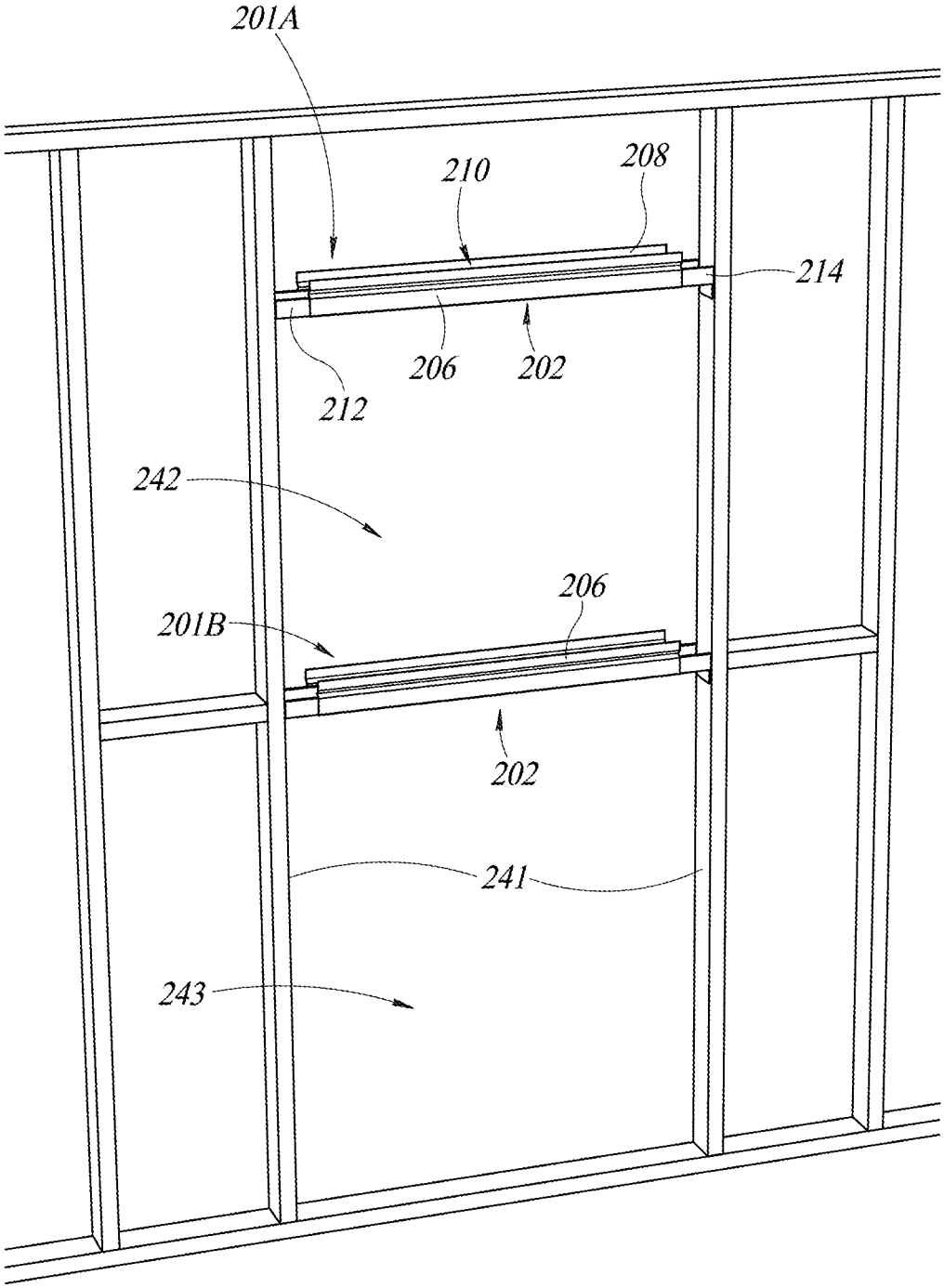
FIG. 9C is a perspective view of the window sill framing members of FIG. 9A installed in a different orientation.

FIGS. 7A to 9C illustrate one or more embodiments of an adjustable header 200 according to the present disclosure. More specifically, FIG. 7A and FIG. 7B are top perspective views of the adjustable header 200 in a retracted and extended configuration, respectively and FIG. 7C is a detail view of a track of the adjustable header 200. FIG. 8A and FIG. 8B are bottom perspective views of the adjustable header 200 in the retracted and extended configuration, respectively. FIGS. 9A-9C are perspective views of the adjustable header 200 coupled to wall studs in typical framing applications.

With reference to FIG. 7A and FIG. 7B, the adjustable header 200 includes a track 202 including a base plate 204 (shown more clearly in FIG. 8A and FIG. 8B), a first flange 206 coupled to the base plate 204 and a second flange 208 coupled to the base plate 204. The first flange 206 is spaced from the second flange 208 across the base plate 204. Further, in some embodiments, the first flange 206 and the second flange 208 are perpendicular to the base plate 204 to provide the track with a U-shaped cross section. The base plate 204, the first flange 206, and the second flange 208 define boundaries of a channel 210. The channel 210 extends along an entire length of the track 202 in some embodiments. In one or more embodiments, the channel 210 does not extend the entire length of the track 202, but rather, extends along only a portion of the track 202, as explained below.

A first support 212 and a second support 214 are coupled to the track 202. More specifically, the first and second supports 212, 214 are received in the track 202 and structured to slide along the track 202. The first and second supports 212, 214 have a size and shape similar to an interior surface of the track 202, such that the first and second supports 212, 214 slide along the channel 210 in the track 202 in a friction fit or clearance fit. The first and second supports 212, 214 may be metal studs of any dimension, in some embodiments. However, the first and second supports 212, 214 may also be any material or stud described herein, as well as other known building materials.

The flanges 206, 208 further include a crimp 216 (which may be also be referred to herein as a groove 216 or indentation 216) extending into the flanges 206, 208 along a length of the flanges 206, 208. In some embodiments, both flanges 206, 208 include the crimp 216 extending the complete length of the respective flange 206, 208, while in one or more embodiments, only one of the flanges 206, 208 includes the crimp 216. Further, the channel 210 may extend along only a portion of the track 202 corresponding to a length of the first and second supports 212, 214. In other words, while FIG. 7A illustrates the first and second supports 212, 214 each extending about halfway along the track 202 in the retracted configuration, the present disclosure contemplates use of shorter supports 212, 214, in which case, the channel 210 may not extend along the entire length of the track 202. Rather, the channel 210 may extend only a quarter, or more or less, of the length of the track 202 on each end of the track 202. Still further, the channel 210 may only extend a portion of the length of the track 202 on only one side of the track 202, in some embodiments. Similarly, the crimp 216 may extend along the flanges 206, 208 in a corresponding manner to the channel 210. As such, the crimp 216 may extend along only a fraction of the track 202 from each end of the track 202, or may extend along a portion of the track 202 from only one end of the track 202, in some embodiments.

The flanges 206, 208 include a sidewall structure that defines the crimp 216, as shown in more detail in FIG. 7C. With reference to FIG. 7A and FIG. 7C, the flanges 206, 208 have a sidewall 217 with a first portion 218A, a second portion 218B, a third portion 218C, and a fourth portion 218D. The first portion 218A extends vertically and perpendicularly to the base plate 204. The second portion 218B is transverse and at a first angle 219A to the first portion 218A. The angle 219A between the first and second portions 218A, 218B of the sidewall 217 may be any value between 0 degrees and 90 degrees between 90 degrees and 180 degrees, or more or less. The third portion 218C is transverse to the second portion 218B and extends from the second portion 218B at a second angle 219B that may be any value between 0 degrees and 180 degrees. In some embodiments, the second angle 219B between the second portion 218B and the third portion 218C of the sidewall 217 is 90 degrees or approximately 90 degrees (i.e. between 85 and 95 degrees). As such, the crimp 216 may be a 45 degree crimp, meaning that each of the second and third portions 218B, 218C are at a 45 degree angle to horizontal and the second angle 219B between the second and third portions 218B, 218C is 90 degrees. In one or more embodiments, the crimp 216 is a 30 degree crimp or a 60 degree crimp, or more or less. The fourth portion 218D is transverse to the third portion 218C and extends vertically to the termination of the sidewall 217. A third angle 219C between the third and fourth portions 218C, 218D may be the same as the first angle 219A. As such, the first and fourth portions 218A, 218D are planar and parallel to each other, in some embodiments. The second and third portions 218B, 218C are perpendicular to each other and transverse to each of the first and second portions 218A, 218D to define the crimp 216.

The crimp 216 extends into the channel 210 and divides the channel 210 into a first channel 220A and a second channel 220B. In the illustrated embodiment, the first channel 220A is below the crimp 216 and the second channel 220B is above the crimp 216. More specifically, the first channel 220A is from the base plate 204 to an interface between the second and third portions 218B, 218C of the sidewall 217 of the flanges 206, 208 and the second channel 220B is from the interface between the second and third portions 218B, 218C of the sidewall 217 of the flanges 206, 208 to the top of the sidewall 217. The first and second supports 212, 214 are received in the first channel 220A and are held in place by the crimp 216. In some embodiments, the first and second supports 212, 214 are in contact with the crimp 216 and more specifically, the first and second supports 212, 214 are received in the first channel 220A in contact with the second portion 218B of the sidewall 217 of the flanges 206, 208. As such, when the header 200 is installed, the crimp 216 holds the supports 212, 214 in place along their length and prevents the supports 212, 214 from sliding out of the track 202 in a vertical direction. The second channel 220B is structured to receive wall studs (which may also be referred to herein as cripple studs) described below with reference to FIG. 9A, among others.

FIG. 7A further illustrates that the first and second supports 212, 214, which may each be metal studs, are completely received in the channel 210 of the track 202 in the retracted configuration of the adjustable header 200. As such, a length of the header 200 in the retracted configuration may be the same as a length of the track 202. In some embodiments, the track 202 has a continuous body with a fixed length. As discussed above, the track 202 can have any length. In some embodiments, the length of the track is any value between 10 inches and 40 inches, or more or less. In the extended configuration of the header 200 in FIG. 7B, the first and second supports 212, 214 slide along the channel 210 relative to the track 202 to extend the length of the header 200. When the first and second supports 212, 214 are fully extended, the header 200 has a second length that is greater than the first length. The second length may be any value between 10 inches and 60 inches, or more or less. Further, the user may select any length between the first and second length by slidably adjusting the first and second supports 212, 214. For example, the header 200 may have a first length of 16 inches and a second or maximum length of 32 inches in one non-limiting example. As such, the user can select to install the header 200 at any length between 16 inches and 32 inches. In some embodiments, the second length of the header 200 is selected based on the dimensions of a rough opening in framing for a window, door, or other material.

The header 200 further includes brackets 222 coupled to the first and second supports 212, 214. More specifically, the brackets 222 are L brackets with a first portion 222A perpendicular to a second portion 222B to give the bracket an L shape with equal length sides, in some embodiments. The first portion 222A of each of the brackets 222 is coupled to the first and second supports 212, 214 and received in a channel 224 extending along each of the supports 212, 214. The second portion 222B of each of the brackets 222 extends away from the track 202 and the channel 210. In other words, the track 202 has a bottom surface 226 (see FIG. 8A) and the second portion 222B of each of the brackets 222 extends away from the bottom surface 226 of the track 202. As explained with reference to FIG. 9A, the second portion of each of the brackets 222 is structured to be coupled to wall studs to secure the adjustable header 200 in place.

FIG. 8A and FIG. 8B illustrate a bottom perspective view of the adjustable header 200 with FIG. 8A showing the header 200 in the retracted configuration and FIG. 8B showing the header 200 in the extended configuration. In the retracted configuration shown in FIG. 8A, the header 200 has a first length 228 that is equal to the fixed length of the track 202, in some embodiments. The first length 228 may also be greater than the length of the track 202 in one or more embodiments where the supports 212, 214 extend beyond the track 202, or where brackets 222 (FIG. 7A) extend beyond the track 202 when the supports 212, 214 are in the retracted configuration. Further, in some embodiments, the bottom surface 226 of the base plate 204 is flat and planar in order to receive drywall or other finishing materials directly on the bottom surface 226 of the base plate 204, however, the same is not necessarily required.

The header 200 has a second length 230 in the extended configuration shown in FIG. 8B that is greater than the first length 228 via extension of the supports 212, 214. In some embodiments, the header 200 is installed with the track 202 centered relative to the supports 212, 214, meaning that the same amount of each support 212, 214 extends from the track 202 on opposite sides of the header 200. However, in one or more embodiments, one of the supports 212, 214 extends further relative to the track 202 than the other support 212, 214. Further, FIG. 8A and FIG. 8B illustrate one or more embodiments of brackets 232, which differ from brackets 222 described with reference to FIG. 7A and FIG. 7B. Brackets 232 may have a similar structure to brackets 222 described herein, but are coupled to the header 200 in a different orientation.

In FIG. 8A and FIG. 8B, the brackets 232 have a portion that is coupled to the supports 212, 214 in a channel of each of the supports 212, 214, similar to brackets 222 (FIG. 7A). However, a second portion of the brackets 232 extends toward the track 202 and further into channel 210 toward the bottom surface 226 of the track 202. As such, the second portion of the brackets 232 extends in an opposite direction from second portion 222B of brackets 222 described above. The present disclosure is therefore not limited by the installation orientation of the brackets 222, 232 coupled to the supports 212, 214.

In some embodiments, the header 200 further includes at least one first hole 234 through each of the brackets 232, and more specifically, through the second portion of the brackets 232, that is structured to receive a fastener to couple the header 200 to wall studs. There may be more than one first hole 234 in each bracket 232, or no first holes 234 in some embodiments. Otherwise, the first holes 234 may have a similar function to the holes described herein with reference to header 100. Further, the header 200 may include one or more second holes 236 through the track 202 proximate ends of the track 202. The second holes 236 are structured to receive a fastener to couple the track 202 to the supports 212, 214. There may be multiple second holes 236 along the track 202, or there may be no second holes 236, in some embodiments. The second holes 236 may align with corresponding holes in the supports 212, 214 or the supports 212, 214 may be solid and without holes, such that the second holes 236 act as a starter for a fastener through the second holes 236. The brackets 232 may be coupled to the first and second supports 212, 214 by any fastener or coupling method, such as screws, bolts, welding, or other like coupling devices and procedures.

FIG. 9A illustrates a perspective view of the adjustable header 200 coupled to wall studs 240 according to the present disclosure. In operation, an operator extends supports 212, 214 from track 202. The brackets 222 may be coupled to the supports 212, 214 in advance of installation. Then, the operator couples the brackets 222 to wall studs 240 framing an opening 242. The brackets 222 secure the supports 212, 214 in position relative to the track 202. Further, in some embodiments, the header 200 is installed with the channel 210 facing upward, or toward the top of a wall. As such, the channel 210, and more specifically, the second channel 220B (FIG. 7B) can receive cripple studs 244 shown here in dashed lines. The wall studs 240 and cripple studs 244, as well as any other stud described herein, may be light or heavy gauge steel studs in sizes from 1⅝" to 12", or more or less, and of any selected length. The wall studs 240 and cripple studs 244 are illustrated in FIG. 9A as being rectangular, similar to dimensional lumber studs, for ease of recognition in the drawings.

The cripple studs 244 are received in the channel 210, above the supports 212, 214 and can be coupled to the track 202 via fasteners through the flanges 206, 208 of the track 202 and into the cripple studs 244. As such, the adjustable header 200 is structured to facilitate more efficient and effective installation of remaining framing components, such as studs 244, in addition to allowing for more efficient installation of headers for variable width openings. Further, the crimp 216 (FIG. 7A) along the flanges 206, 208 allows for separation between the supports 212, 214 and the studs 244 in the installed configuration, while still presenting a generally flat and planar outer surface for receiving drywall over the header 200. In other words, the crimp 216 (FIG. 7A) in the flanges 206, 208 is small enough that it does not impact or change the shape of drywall installed over the header 200.

FIG. 9B and FIG. 9C illustrate additional embodiments of framing applications. While FIG. 9A illustrates a framing application with an opening 242 for a door, for example, the concepts of the disclosure can also be applied in framing other openings, such as for windows.

In FIG. 9B, a first window sill framing member 201A is coupled to window placement studs 241. Then, a second window sill framing member 201B is coupled to the window placement studs 241 in a similar manner and in spaced relationship to the first window sill framing member 201A to define outer boundaries of opening 242. The first and second window sill framing members 201A, 201B may be similar to the adjustable headers 200 described herein, but may have different dimensions or other features for use as window sill framing members. For example, each of the window sill framing members 201A, 201B include the track 202 with flanges 206 and supports 212, 214 configured to slide relative to the track 202 to change the length of the window sill framing members 201A, 201B. The dimensions of the opening 242 (i.e. the distance between the window sill framing members 201A, 201B as well as between studs 241) can be selected according to the size of the window or other like structure to be installed in the opening 242. In other words, the width and height of the opening 242, and thus the position of the window sill framing members 201A, 201B, can be selected according to design factors such as the rough opening size for the material or device being installed in the opening 242.

In FIG. 9B, the second window sill framing member 201B is installed with a flat and planar surface of the track 206 facing the first window sill framing member 201A and the flanges 206 of the track 202 of the second window sill framing member 201B facing away from the first window sill framing member 201A. As such, cripple studs can be coupled to the second window sill framing member 201B and bottom studs 240, similar to cripple studs 244 at the top of the framing in FIG. 9A, in some embodiments. Further, trimmer or jack studs can be coupled to the first and second window sill framing members 201A, 201B and adjacent the window placement studs 241, in some embodiments, similar to trimmer studs 116 in FIG. 2, except with a different length to accommodate the size of the opening 242. In some embodiments, a third window sill framing member is coupled to the window placement studs 241 adjacent the second window sill framing member 201B to create a double window sill plate. In one non-limiting example, the third window sill framing member is installed in the orientation of the second window sill framing member 201B described with reference to FIG. 9C below, or in other words, with the flat and planar surface of the track 202 of the second and third window sill framing members facing each other.

In some embodiments, as in FIG. 9C, the second window sill framing member 201B is installed with the flanges 206 of the track 202 facing the first window sill framing member 201A. As such, additional studs can be coupled between the window sill framing members 201A, 201B, such as when the opening for a window has a width less than the width between the studs 241 in one non-limiting example, or the second window sill framing member 201B may be used for creating an additional opening 243 below the second window sill framing member 201B. Still further, the second window sill framing member 201B can be used similar to the fire blocks 112 (FIG. 2) described herein, in some embodiments. In addition, while FIG. 9B and FIG. 9C illustrate two window sill framing members 201A, 201B coupled to the studs 241, the present disclosure also contemplates the use of more or less than two window sill framing members 201A, 201B, such as one, three, four, five, or more window sill framing members 201A, 201B in certain applications.

Figure 10A:
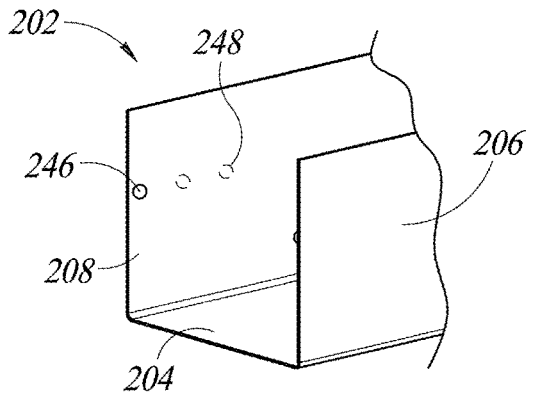
FIGS. 10A-10I are partial perspective views of embodiments of a track according to the present disclosure.

FIGS. 10A-10I are partial perspective views of embodiments of the track 202 described herein. With reference to FIG. 10A, the track 202 includes an alignment bump 246 coupled to and extending from the flanges 206, 208 of the track 202 instead of the crimp 216. The bump 246 may be a rounded protrusion extending from each of the flanges 206, 208 or from only one of the flanges 206, 208 in some embodiments. The location of the bump 246 along a height and length of each of the flanges 206, 208 can be selected. Further, there may be more than one bump 246 on each flange 206, 208, as indicated by dashed lines 248 in FIG. 10A. Similar to crimp 216, the bump 246 holds the first and second supports 212, 214 in place.

Figure 10B:
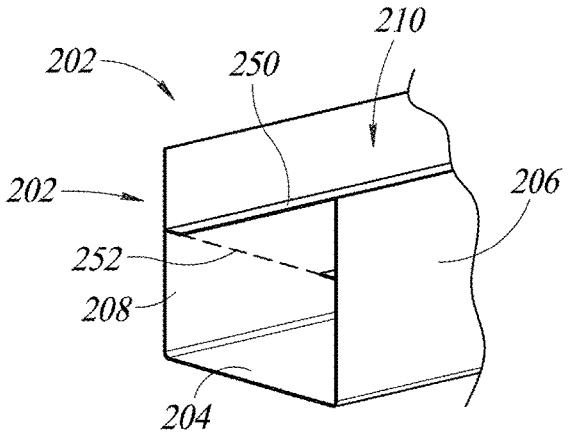

FIG. 10B illustrates the track 202 having a plate 250 coupled to and extending from each of the flanges 206, 208 of the track 202 into the channel 210. Each of the plates 250 may extend from the flanges 206, 208 along a complete length of the flanges 206, 208 or along only a portion or along only selected portions of the length of the flanges 206, 208 in some embodiments. Further, a width of the plates 250 can be selected and may, in some embodiments, include the plate 250 extending from the first flange 206 the second flange 208, as indicated by dashed lines 252. In other words, the plate 250 extends across the entirety of channel 210 between both flanges 206, 208, in some embodiments. In one or more embodiments, the plate 250 is on only one of the flanges 206, 208, while in some embodiments, there is a plate 250 on each of the flanges 206, 208, as shown. Similar to crimp 216, the plates 250 hold the supports 212, 214 in place during operation and also provide a surface for receiving the cripple studs 244 (FIG. 9A).

Figure 10C:
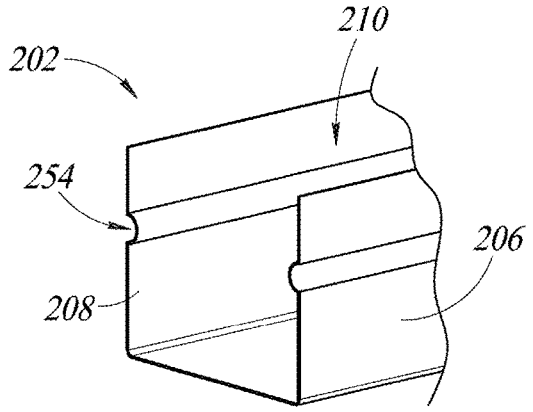
Figure 10D:
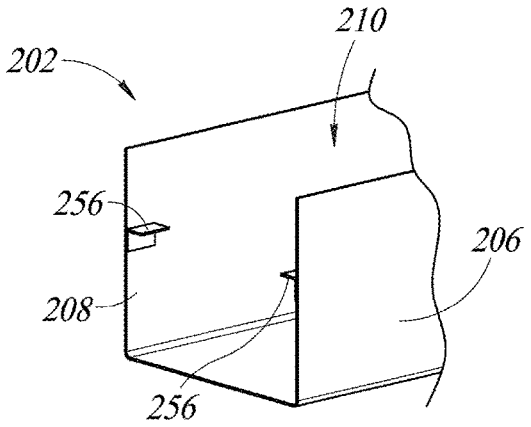

FIG. 10C illustrates the track 202 having a rounded crimp 254 in each of the flanges 206, 208 of the track 202. The rounded crimp 254 can be used in place of crimp 216, but maintains a similar function as crimp 216 described herein. Further, the rounded crimp 254 may be on only one of the flanges 206, 208, or both of the flanges 206, 208, as shown, in some embodiments. The rounded crimp 254 may only be in some selected portion or portions of each flange 206, 208, or may extend along an entirety of the flange 206, 208, in one or more embodiments. FIG. 10D illustrates one or more embodiments of the present disclosure where track 202 includes brackets 256 instead of the crimp 216. The brackets 256 have a similar function as the crimp 216 and may be coupled to the flange 206, 208 with fasteners or with any fastening method, such as of the types described herein as well as other like devices and methods. Further, each flange 206, 208 may have only one bracket 256, or may have more than one bracket 256 along the length of each flange 206, 208 spaced apart from each other.

Figure 10E:
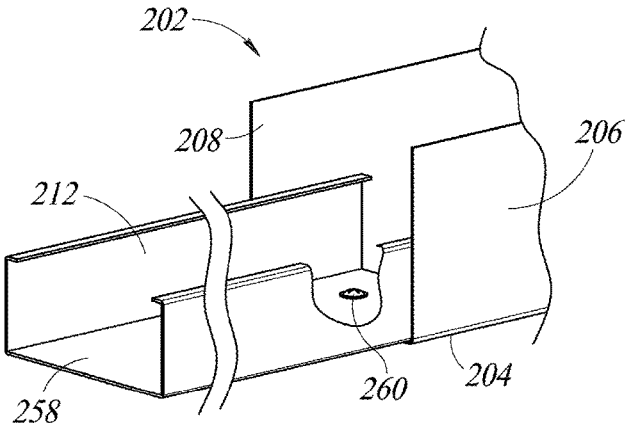

FIG. 10E illustrates an embodiment of the track 202 with a fastener 260 coupled to the first support 212 and the track 202. In some embodiments, the track 202 does not include any additional structure for holding the supports 212, 214 in place, but rather, the supports 212, 214 are adjusted to the width of an opening, and described herein, and the fastener 260 is used to cupled the supports 212, 214 to the track in the installation position. The fastener 260 may be a screw or bolt. Further, while the fastener 260 is illustrated as being inserted through a base 258 of the first support 212 and the base plate 204 of the track 202, embodiments of the present disclosure also include the fastener 260 installed in the opposite orientation, namely inserted upwards through the base plate 204 of the track 202 first and then through the base 258 of the first support 212. There may be only one fastener 260 per support 212, 214, or in some embodiments, there may be more than one fastener 260 per support 212, 214. Further, either the track 202 or the first support 212, or both, may have pre-formed holes for receiving the fastener 260, as described herein.

Figure 10F:
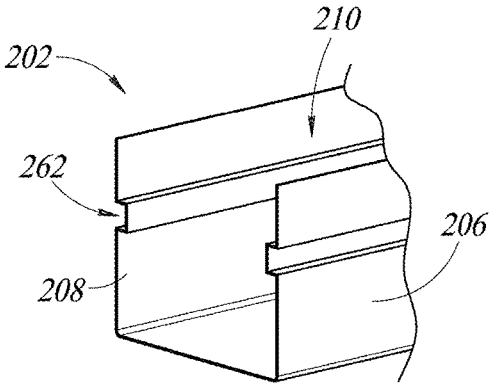

FIG. 10F illustrates an embodiment of the track 202 having a square crimp 262 in each of the flanges 206, 208. The square crimp 262 is a 90 degree crimp, such that the crimp 262 extends horizontally into the channel 210 of the track 202, or perpendicularly to the flanges 206, 208. The square crimp 262 is similar to function to crimp 216 described herein. Further, each of the flanges 206, 208 may include the square crimp 262 or only one of the flanges 206, 208 may include the square crimp 262. The square crimp 262 may extend along a complete length of each flange 206, 208 or may extend along only a portion or selected portions of each flange 206, 208.

Figure 10G:
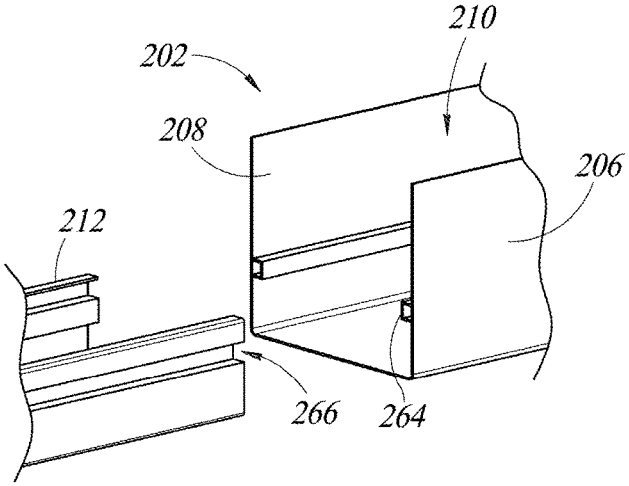

FIG. 10G illustrates one or more embodiments of the track 202 with a ridge 264 (which may also be described herein as a rail 264) coupled to and extending from each flange 206, 208 into the channel 210. The ridge 264 is sized, shaped, and structured to be received in a corresponding channel 266 in the first and second supports 212, 214. The ridges 264 and corresponding channels 266 secure the first and second supports 212, 214 in position relative to the track 202. Further, the ridges 264 may extend along an entirety of each flange 206, 208 or may extend along only a portion or selected portions of each flange 206, 208. Similarly, the channels 266 may extend along an entirety of supports 212, 214, or along only a portion of the supports 212, 214 corresponding to the ridges 264.

Figure 10H:
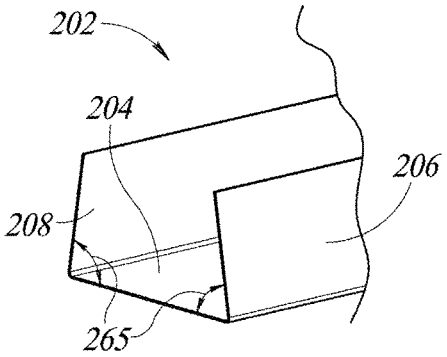

FIG. 10H is a partial perspective view of one or more embodiments of the track 202 wherein the flanges 206, 208 of the track 202 are at an angle 265 relative to the base plate 204, such that the track 202 receives the supports 212, 214 in a friction fit to secure the supports 212, 214 in place. In some embodiments, the flanges 206, 208 are vertical and perpendicular to the base plate 204, such as in FIG. 7A above. However, in FIG. 10H, the flanges 206, 208 are at the angle 265 to the base plate 204. In some embodiments, the angle 265 is any value greater than 0 degrees and less than 90 degrees relative to the base plate 204 of the track 202. In one or more embodiments, the flanges 206, 208 can be at any transverse angle to the base plate 204.

Figure 10I:
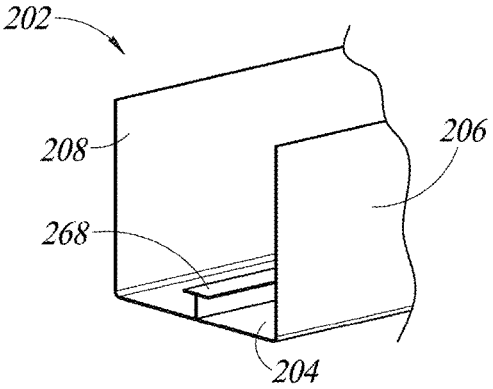

FIG. 10I illustrates one or more embodiments of the track 202 having a protrusion 268 coupled to and extending from the base plate 204. The protrusion 268 has a T shape with a vertical base and a horizontal flange at the top of the base. The supports 212, 214, although not shown, have a correspondingly shaped channel in the bottom of the support 212, 214 for receiving the protrusion 268 to hold the supports 212, 214 in place. Further, the top flange of the protrusion 268 may not be horizontal to the base, in some embodiments. For example, the flange be at any angle to the base, or may have a different shape than that shown in FIG. 10I. In some non-limiting examples, the flange is a square, triangle, trapezoid, or any other geometric or rectilinear shape. As such, embodiments of the present disclosure include several different variations for securing the supports 212, 214 to the track 202. In some embodiments, the crimp 216 and the other structures for retaining supports 212, 214 in the track 202 described above with reference to FIGS. 10A-10I may be referred to as a divider for separating the channel 210 into the first and second channels 220A, 220B (FIG. 7B).

Figure 11A:
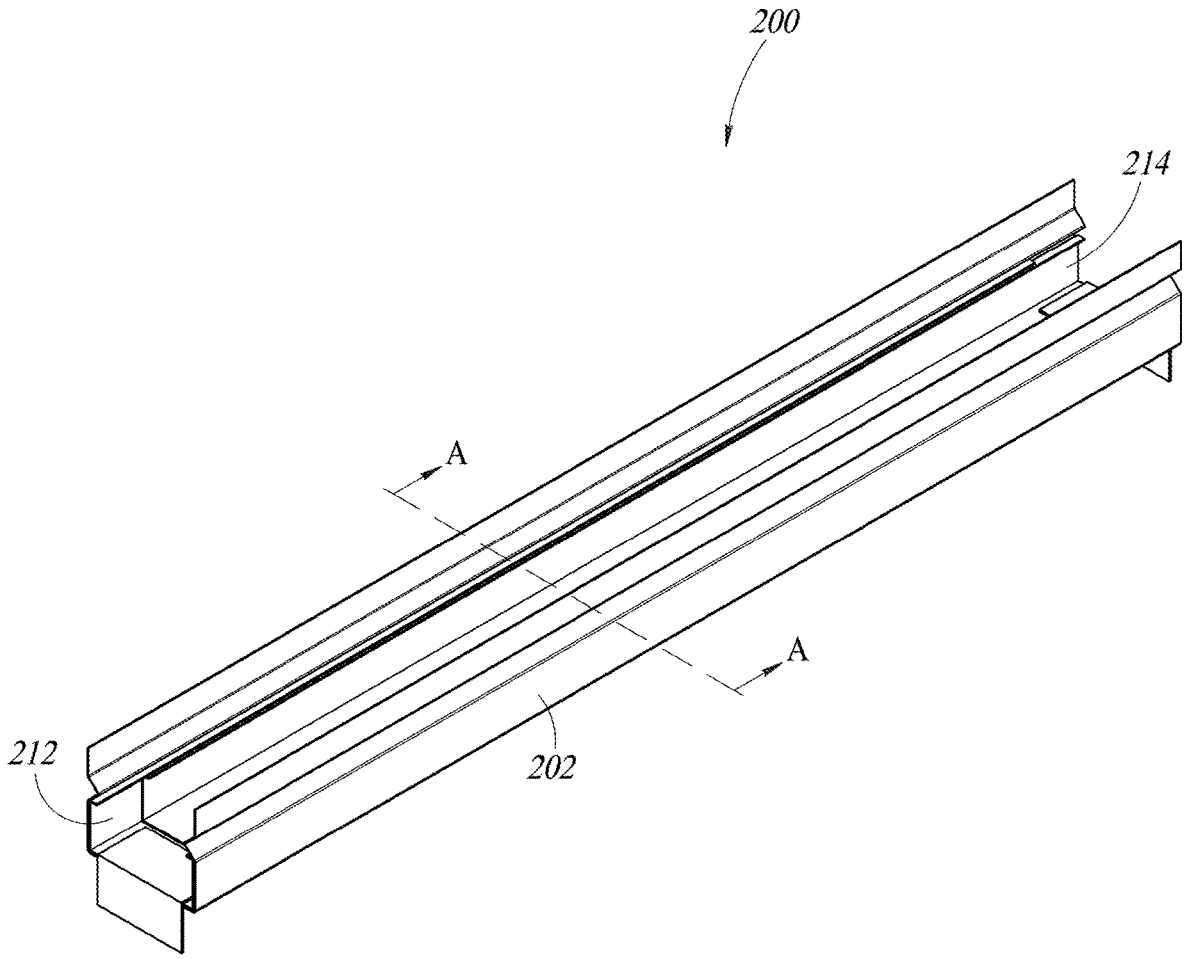
FIG. 11A is a perspective top view of an embodiment of an adjustable header according to the present disclosure in a collapsed configuration.
Figure 11B:
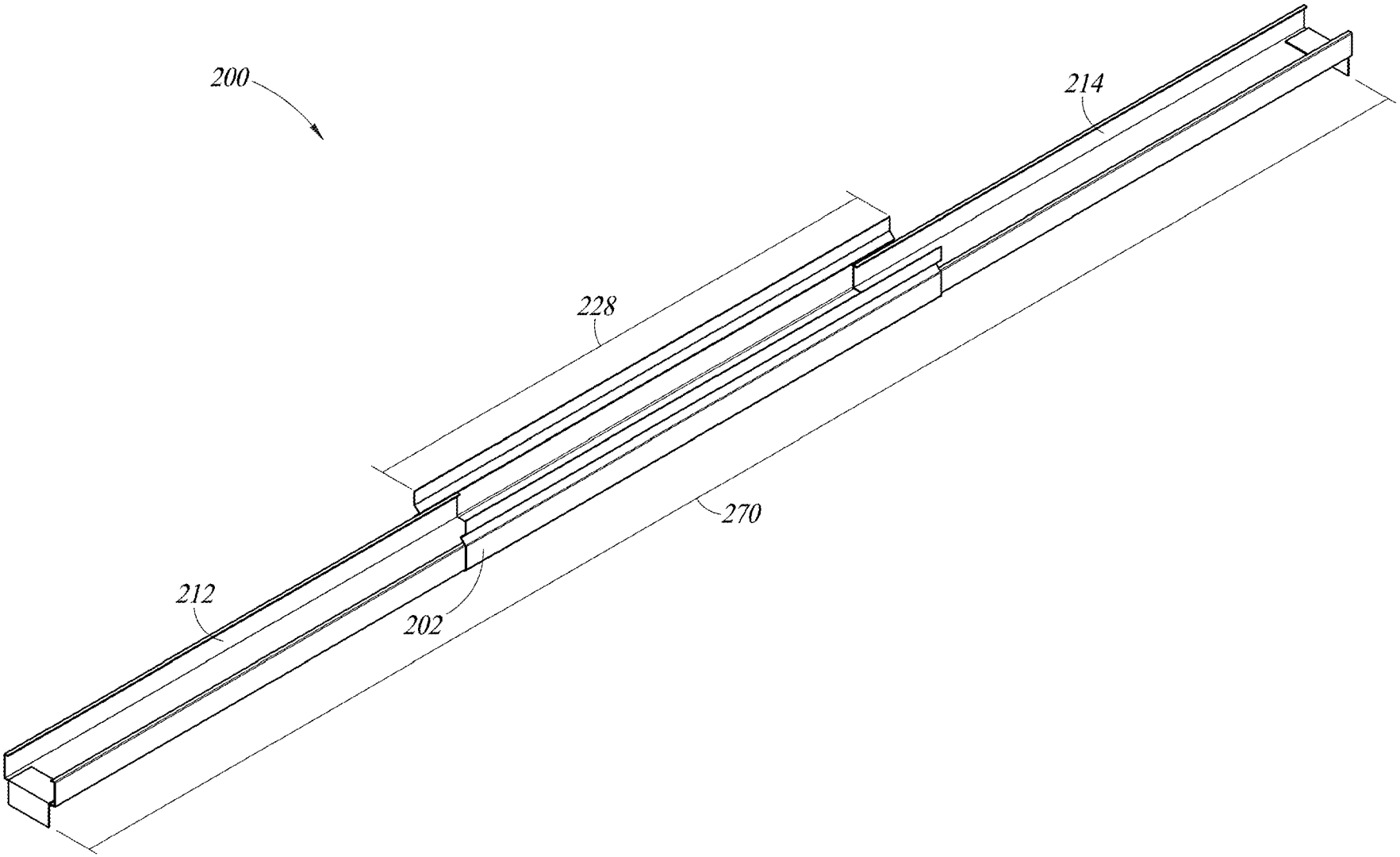
FIG. 11B is a perspective top view of the adjustable header of FIG. 11A in an extended configuration.
Figure 11C:
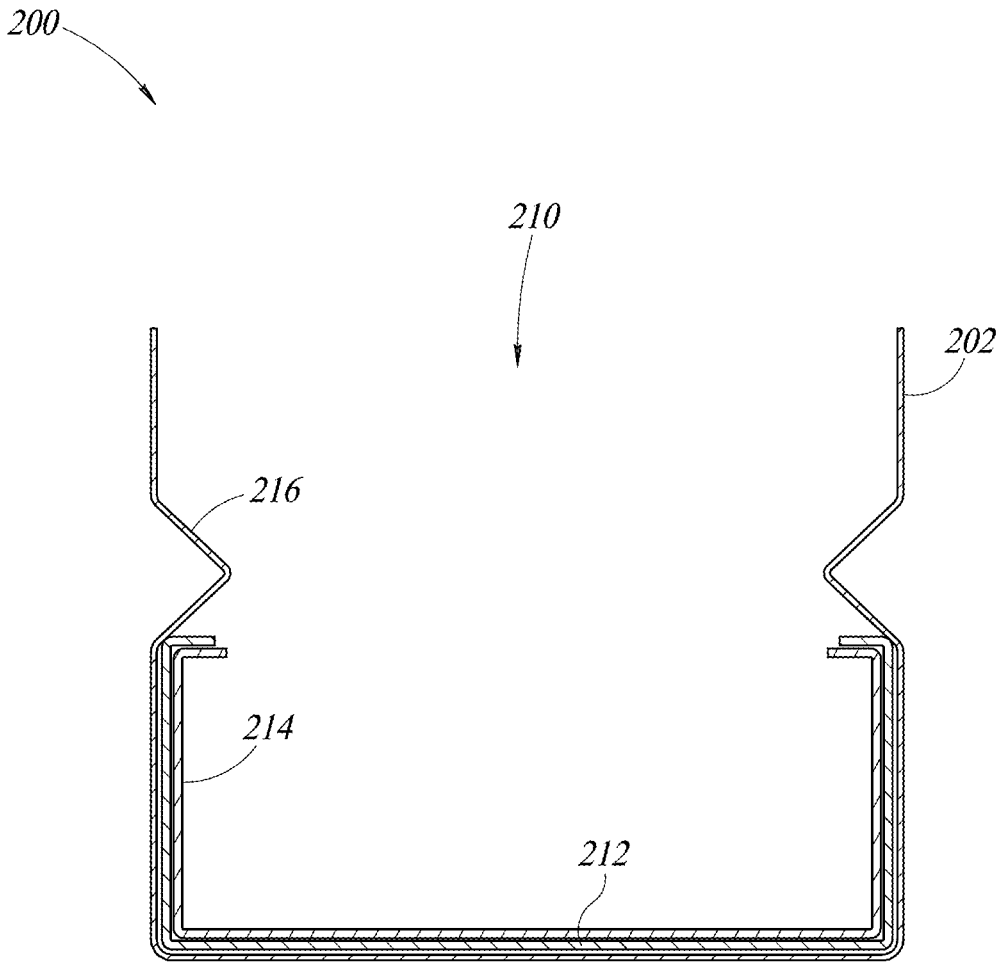
FIG. 11C is a cross-sectional view of the adjustable header of FIG. 11A along line A-A in FIG. 11A.

FIGS. 11A-11C illustrate further embodiments of the adjustable header 200. The header 200 includes the track 202 with the first and second supports 212, 214 received in the track 202 and configured to slide along the track 202, as described herein. However, in some embodiments, the first and second supports 212, 214 are in a telescopic arrangement relative to each other, with the second support 214 nested within the first support 212 in the collapsed configuration shown in FIG. 11A. In other words, rather than the first and second supports 212, 214 being spaced from each other in the collapsed configuration, as in FIG. 7A, the first and second supports 212, 214 are telescopically arranged in some embodiments to further increase the extension range of the adjustable header 200 in the extended configuration. In some embodiments, the length of the each of the first and second supports 212, 214 are the same and are equal to the length of the track 202, such that the supports 212, 214 are nested along an entire length of the track 202. In one or more embodiments, as in FIG. 11A, the length of each of the supports 212, 214 is greater than half of the length of the track 202, but is less than the full length of the track 202, with the supports 212, 214 nested at the middle of the track 202 such that ends of the supports 212, 214 remain spaced from the ends of the track 202.

FIG. 11B illustrates the adjustable header 200 of FIG. 11A in an extended configuration. In FIG. 11B, the supports 212, 214 slide relative to each other and the track 202 to extend from the track 202. As referenced above, the nesting or telescoping configuration of the supports 212, 214 extends the extension range of the header 200, such that the same header 200 can be used with a greater range of rough openings of different widths in framing applications. In one non-limiting example, the header 200 in the extended configuration has a length 270 that is greater than the second length 230 of the header 200 described above with reference to FIG. 8B. In some embodiments, the length 270 is at least 50%, 60%, 70%, 80%, 90% or more or less greater than the length 230. In addition, the track 202 has the length 228 and the length 270 in the extended configuration in some embodiments with telescoping supports 212, 214 may be up to three times greater than the length 228, or more or less, at maximum extended range.

FIG. 11C is a cross-sectional view of the header 200 along line A-A in FIG. 11A. In FIG. 11C, the second support 214 is nested within the first support 212. As such, the dimensions of the second support 214 are selected to be less than the dimensions of an inside surface of the first support 212, such that the second support 214 is received within the first support 212. However, the first support 212 can be received telescopically within the second support 214 in some embodiments. As such, embodiments of the present disclosure include the supports 212, 214 having different dimensions and sizes in order to provide for a nesting or telescoping arrangement, as opposed to the supports 212, 214 having the same size as in other embodiments (see, e.g., FIG. 7A and others). Moreover, the change in dimensions of one of the supports 212, 214 (here, the second support 214) to provide for telescoping between the supports 212, 214 does not impact the ability of the second support 214 to slide in and out of the track 202 or to be secured by the track 202 in the extended configuration. The crimp 216 in the track 202 extends further into the channel 210 than the outer edges of the second support 214, such that the second support 214 can still slide relative to the track 202 with the crimp 216 holding the second support 214 in place. The same is true for other embodiments of the track 202 described herein, such as with reference to FIGS. 10A-10I, and others.

As such, the systems, devices, and methods described herein provide a header with an adjustable length in order to fit openings of varying width. The headers described herein can be prefabricated and used for a range of openings and can also be installed in a number of different orientations, depending on the selected framing configuration. Such headers reduce the amount of measuring and cutting on job sites, which increases efficiency and lowers construction costs. Further, the headers described herein may be reusable by removing the header during remodeling and using the header again for a different size opening, which is more efficient than single use headers.

In the above description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with headers and framing systems have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first," "second," and similar indicators of sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" or other like phrases, such as "in one or more embodiments" or "in some embodiments" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense that is as meaning "and/or" unless the content clearly dictates otherwise.

Relative terms such as "approximately," "substantially," and other like terms, when used to describe a value, amount, quantity, or dimension, generally refer to a value, amount, quantity, or dimension that is within plus or minus 5% of the stated value, amount, quantity, or dimension, unless the context clearly dictates otherwise. It is to be further understood that any specific dimensions of components or features provided herein are for illustrative purposes only with reference to the various embodiments described herein, and as such, it is expressly contemplated in the present disclosure to include dimensions that are more or less than the dimensions stated, unless the context clearly dictates otherwise.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:

an adjustable header, including:

a track, including:

a base plate;

a first flange coupled to the base plate;

a second flange coupled to the base plate and spaced from the first flange across the base plate; and a channel, wherein the first flange and the second flange each include a crimp to separate the channel of the track into a first channel and a second channel;

a first support received in the first channel of the track and structured to slide relative to the track; and a second support received in the first channel of the track and structured to slide relative to the track, wherein the adjustable header is manipulatable between a first position and a second position, the adjustable header having a first length in the first position and a second length in the second position greater than the first length.

2. The device of claim 1 wherein the track has a fixed length, the first length of the adjustable header being approximately equal to the fixed length of the track.

3. The device of claim 1 wherein the second channel is configured to receive at least one cripple stud.

4. The device of claim 1, further comprising:

a first bracket coupled to the first support; and a second bracket coupled to the second support, wherein at least one of the first bracket and the second bracket include a portion extending away from the track.

5. The device of claim 1 further comprising:

a first bracket coupled to the first support; and a second bracket coupled to the second support, wherein at least one of the first bracket and the second bracket include a portion extending toward the track.

6. The device of claim 1 wherein the first flange and second flange are integral with the base plate and coupled to the base plate, the first flange, the second flange, and the base plate being part of the same continuous member.

7. A system, comprising:

a track including a base, a first flange, and a second flange defining a channel, wherein at least one of the first flange and the second flange include a crimp to separate the channel of the track into a first channel and a second channel;

a first support received in the first channel and structured to slide relative to the track between a first position and a second position, wherein an end of the first support is proximate the track in the first position of the first support and wherein the end of the first support is spaced from the track in the second position of the first support; and a second support received in the first channel and structured to slide relative to the track between a first position and a second position.

8. The system of claim 7 wherein an end of the second support is proximate the track in the first position of the second support and wherein the end of the second support is spaced from the track in the second position of the second support.

9. The system of claim 7 wherein each of the first and second flanges include respective crimps extending into the channel to separate the channel into the first channel and the second channel.

10. The system of claim 7 wherein the second channel is configured to receive at least one stud.

11. The system of claim 7 wherein the first support is a stud having a channel extending along a length of the stud, the system further comprising:

a bracket coupled to the stud and having a first portion received in the channel of the stud and a second portion extending away from the channel of the stud.

12. The system of claim 7 wherein the first support is a stud having a channel extending along a length of the stud, the system further comprising:

a bracket coupled to the stud and having a first portion received in the channel of the stud and a second portion extending into the channel of the stud.

13. A system, comprising:

a track including a base, a first flange, and a second flange defining a channel;

a first support received in the channel and structured to slide relative to the track between a first position and a second position, wherein an end of the first support is proximate the track in the first position of the first support and wherein the end of the first support is spaced from the track in the second position of the first support; and a second support received in the channel and structured to slide relative to the track between a first position and a second position, wherein the second support is received in the first support in a telescoping arrangement in the first position of the first support.

14. The system of claim 13 wherein at least one of the first flange and the second flange includes a dividing element to separate the channel of the track into a first channel and a second channel.

15. The system of claim 14 wherein the first support and the second support are received in the first channel, the second channel configured to receive a stud.

16. The system of claim 14 wherein the dividing element extends along a complete length of the at least one of the first flange and the second flange.

17. A device, comprising:

an adjustable header including:

a first support having a channel and a divider extending into the channel to separate the channel into a first channel and a second channel, the second channel structured to receive a stud; and a second support received in the first channel and structured to slide relative to the first support, wherein the adjustable header is manipulatable between a first position and a second position, the adjustable header having a first length in the first position and a second length in the second position greater than the first length, and wherein the divider extends along a complete length of the first support.

18. The device of claim 17 further comprising:

a third support received in the first channel and structured to slide relative to the first support;

a first bracket coupled to the second support; and a second bracket coupled to the third support.

19. The device of claim 17 wherein the first support further includes a first flange and a second flange and the divider is a first divider extending from the first flange into the channel, the device further comprising:

a second divider extending from the second flange into the channel.

20. The device of claim 17 wherein in the first position of the adjustable header, the second support is received within the first support and wherein in the second position of the adjustable header, the second support extends from the first support.

21. The device of claim 17 wherein the adjustable header has a length in the first position and the first support has a fixed length that is approximately equal to the length of the adjustable header in the first position.

* * * * *